US006364418B1

(12) United States Patent
Schwoebel

(10) Patent No.: US 6,364,418 B1
(45) **Date of Patent: *Apr. 2, 2002**

(54) CUTTING HEADS FOR HORIZONTAL REMOTE MINING SYSTEM

(75) Inventor: Jeff Schwoebel, Free Union, VA (US)

(73) Assignee: Amvest Systems, Inc., Charlottesville, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/191,183

(22) Filed: Nov. 13, 1998

Related U.S. Application Data

(63) Continuation-in-part of application No. 08/745,459, filed on Nov. 12, 1996, now Pat. No. 5,879,057.

(60) Provisional application No. 60/079,835, filed on Mar. 30, 1998, provisional application No. 60/079,941, filed on Mar. 30, 1998, provisional application No. 60/093,357, filed on Jul. 20, 1998, and provisional application No. 60/092,881, filed on Jul. 15, 1998.

(51) Int. Cl.[7] ..... E21C 25/60; E21C 35/187; E21C 35/23

(52) U.S. Cl. ..... 299/17; 299/57; 299/60; 299/81.2; 175/67

(58) Field of Search ..... 299/16, 17, 55–57, 299/58–60, 85.1, 81.1, 81.2; 175/67, 393, 394, 424

(56) References Cited

U.S. PATENT DOCUMENTS

| | | | | | |
|---|---|---|---|---|---|
| 2,218,130 | A | | 10/1940 | Court | 15/104.12 |
| 2,594,256 | A | * | 4/1952 | Compton | 299/87.1 |
| 2,605,090 | A | * | 7/1952 | Jacobsen | 299/8 |
| 2,775,439 | A | * | 12/1956 | McCarthy | 175/53 |
| 3,149,882 | A | * | 9/1964 | Silks et al. | 299/56 |
| 3,155,177 | A | | 11/1964 | Fly | 175/67 |
| 3,203,736 | A | | 8/1965 | Andersen | 299/17 |
| 3,393,756 | A | * | 7/1968 | Mori | 175/258 |
| 3,645,346 | A | | 2/1972 | Miller et al. | 175/237 |
| 3,746,110 | A | * | 7/1973 | Young et al. | 175/85 |
| 3,797,590 | A | | 3/1974 | Archibald et al. | 175/213 |
| 3,856,357 | A | * | 12/1974 | Wharton | 299/12 |
| 3,876,254 | A | * | 4/1975 | Parker | 299/81.2 |
| 3,949,815 | A | * | 4/1976 | Bryant, Jr. et al. | 173/189 |
| 4,049,318 | A | * | 9/1977 | Fruin | 299/81.2 |
| 4,077,481 | A | | 3/1978 | Bunnelle | 175/232 |
| 4,077,671 | A | | 3/1978 | Bunnelle | 299/17 |
| 4,296,970 | A | | 10/1981 | Hodges | 299/67 |
| 4,391,339 | A | * | 7/1983 | Johnson, Jr. et al. | 175/393 |
| 4,401,345 | A | | 8/1983 | Archibald | 299/64 |
| 4,444,278 | A | * | 4/1984 | Rocchetti | 175/108 |
| 4,494,618 | A | | 1/1985 | Radtke | 175/393 |
| 4,534,427 | A | * | 8/1985 | Wang et al. | 175/67 |
| 4,536,035 | A | | 8/1985 | Huffman et al. | 299/17 |
| 4,575,155 | A | | 3/1986 | Hodges | 299/17 |
| 4,624,327 | A | * | 11/1986 | Reichman | 175/67 |
| 4,718,728 | A | | 1/1988 | Hodges | 299/17 |
| 4,723,612 | A | | 2/1988 | Hicks | 175/393 |
| 4,733,914 | A | | 3/1988 | Kogelmann | |
| 4,765,686 | A | | 8/1988 | Adams | |

(List continued on next page.)

*Primary Examiner*—David Bagnell
*Assistant Examiner*—Sunil Singh
(74) *Attorney, Agent, or Firm*—Jenkens & Gilchrist

(57) ABSTRACT

Cutting heads, cutting head systems, and methods for creating an excavation in a mineral seam. A preferred cutting head includes a first body having a manifold for containing high pressure fluid and an axis of rotation generally parallel to the borehole, a first plurality of mechanical bits disposed on the first body, a first plurality of nozzles disposed around the axis of rotation for spraying the high pressure fluid, and a plurality of tubes fluidly coupling the manifold and the first plurality of nozzles. On supplying high pressure fluid to the manifold and rotating the cutting head about the axis of rotation, the nozzles create a generally circular, overlapping pattern of high pressure fluid in front of the cutting head, the pattern of high pressure fluid being directed to cut the borehole independently of the mechanical bits.

97 Claims, 7 Drawing Sheets

U.S. PATENT DOCUMENTS 4,871,037 A * 10/1989 Warren et al. ..... 175/67
4,878,712 A 11/1989 Wang ..... 299/10
5,110,188 A * 5/1992 Kawai et al. ..... 299/10
5,123,708 A * 6/1992 Akesaka ..... 405/141
5,197,783 A 3/1993 Theimer et al. ..... 299/17
6,017,095 A * 1/2000 DiMillo ..... 299/56

* cited by examiner

CUTTING HEADS FOR HORIZONTAL REMOTE MINING SYSTEM

This application is a continuation-in-part of commonly owned U.S. application Ser. No. 08/745,459, filed Nov. 12, 1996, which issued as U.S. Pat. No. 5,879,057 on Mar. 9, 1999, and which is incorporated herein by reference. This application also claims the benefit of U.S. Provisional Application No. 60/079,835, filed Mar. 30, 1998; U.S. Provisional Application No. 60/079,941, filed Mar. 30, 1998; U.S. Provisional Application No. 60/093,357, filed Jul. 20, 1998; and U.S. Provisional Application No. 60/092,881, filed Jul. 15, 1998, all of which are incorporated herein by reference.

FIELD

The present invention generally pertains to drilling and mining processes and, more particularly, but not by way of limitation, to a mining system particularly adapted for the recovery of coal from relatively thin, generally horizontal mineral seams. The present invention further pertains to cutting heads for such a mining system.

HISTORY OF THE RELATED ART

The recovery of coal from coal seams has been the subject of technical development for centuries. Among the more conventional mining techniques, hydraulic mining systems have found certain industry acceptance. Hydraulic mining typically utilizes high pressure water jets to disintegrate material existing in strata or seams generally disposed overhead of the water jets. The dislodged material is permitted to fall to the floor of the mining area and is transported to the mining surface via gravity and/or water in a flume or slurry pipeline. Along these lines, certain developments in Russia included a series of hydro-monitors capable of extracting a strip of coal 3 feet wide and 30 to 40 feet in depth within a matter of minutes. The units were designed to be conveyed on a track to the advancing coal face for extracting the coal. The coal would flow downwardly and be transported to the surface via a flume. Similar techniques to this have found commercial acceptance in China, Canada, and Poland, but only limited attempts have been made to use these techniques in the United States.

Although not as widely accepted in the United States, hydraulic mining methods have been the subject of numerous U.S. patents. U.S. Pat. No. 3,203,736 to Anderson describes a hydraulic method of mining coal employing hydraulic jets of water of unusually small diameter to cut the coal. Such techniques would be particularly applicable to steeply dipping coal seams. Likewise, U.S. Pat. No. 4,536,052 to Huffman describes a hydraulic mining method permitting coal removal from a steeply dipping coal seam by utilizing a vertical well drilled at the lowest point of the proposed excavation. Another slant borehole is drilled at the bottom of the coal seam to intersect with the vertical well. High pressure water jets are then used to disintegrate the coal in a methodical fashion with the resulting slurry flowing along the slant borehole into the vertical well. Once in the well, this coal slurry could be pumped to the surface of the mine. While effective in steeply dipping coal seams where gravity would allow the slurry to flow to the vertical well, other techniques would be necessary for more horizontally oriented mining systems. Additionally, U.S. Pat. No. 4,878,722 to Wang teaches the use of water jets to remove horizontal slices of coal within a seam. Through the sequential mining of layers in this manner from top to bottom, the entire seam of coal can be extracted and the mine roof subsides onto the floor without need for artificial roof support.

Another technique for extracting minerals from subterranean deposits is the above referenced borehole mining. Such techniques create minimal disturbance at the mining surface while water jets are used to cut or erode the pay zone and create a slurry down hole. A sump is created below the pay zone to collect the produced cuttings and slurry, which is transported to the surface via a jet or slurry pump. A wide variety of minerals, primarily soft rock formations, may also be mined utilizing this technique. A more recent borehole mining technique is described in U.S. Pat. No. 3,155,177 to Fly wherein a process for under reaming a vertical well and a hydrocarbon reservoir is shown. The technique illustrated therein utilizes electric motors to convert the apparatus from drilling to under reaming.

More conventional techniques are seen in U.S. Pat. Nos. 4,077,671 and 4,077,481 to Bunnelle which describe methods of and apparatus for drilling and slurry mining with the same tool. A related borehole mining technique is shown in U.S. Pat. No. 3,797,590 to Archibald which teaches the concept of completely drilling the vertical well through the portion of the strata to be mined. Separate lines are used for water jet cutting and slurry removal. A progressive cavity pump is used to tort slurry to the surface. In the later improvement (U.S. Pat. No. 4,401,345) the cutting tool is moved independently from the pumping unit. Later developments shown in U.S. Pat. No. 4,296,970 describe the use of various types of rock crushers at the inlet of the jet pump. A feed screw on the bottom of the drill string is used to meter the flow of slurry into the orifice of a venturi in association with the rock crusher. In a subsequent development (U.S. Pat. No. 4,718,728), it is suggested to use a tri-cone bit assembly on the end of the tool to reduce the particle size to allow slurry transport. In U.S. Pat. No. 5,197,783 an extensible arm assembly is incorporated to allow the water jet cutting mechanism to extend outwardly from the borehole mining tool to provide more effective cutting in the water filled cavity.

The above described mining techniques present methods of and apparatus for mineral excavation for sites with specific geological characteristics. In the main such characteristics include steeply dipping coal seams and/or gravity to facilitate transport of the coal to the surface. Transport of the coal, however, is not the only design problem. The distance between the cutting face and the water jet unit increases as material is eroded away. Cutting effectiveness therefore decreases until the unit is moved. These specific design points have been referred to above and are areas of continued technical development. This is particularly true due to the fact that in borehole mining, cutting effectiveness of the water jets also decreases as the cavity becomes larger in size. When the cavity reaches a point that cutting effectiveness diminishes, either another vertical well must be installed to initiate another cavity or the cutting unit needs to be moved closer to the coal face. Also, when a cavity is creed in unconsolidated material, subsidence may be created and the cavity may collapse. Borehole mining is, therefore, referred to as a selective mining technique and may not always be suitable for low cost extraction on a large scale basis.

In addition, although hydraulic mining techniques have proven effective in the cutting of certain seams of coal, water jets or other hydraulic cutting systems may not cut effectively when rock strata are present within the coal seam. The presence of rock strata often requires that a prohibitively high water pressure be supplied to the water jets to cut the rock bands, requiring too much horsepower for economic coal extraction of the system.

Another conventional technique for extracting minerals from subterranean deposits is a scroll auger. Scroll augers have been used to mine relatively thin, generally horizontal seams of coal. Scroll augers typically include a cylindrical auger used to transport cut coal away from a cutting head located on the front of the auger. The cutting head typically cores and breaks coal by using mechanical bits on the circumference and center of a hollow cylinder located on the front of the auger. The auger and cutting head are rotated, and advanced into a coal seam, using a conventional auger drill unit that is coupled to the rear of the auger. The scroll auger and auger drill unit are positioned on a high wall bench on the surface or in some cases underground within a subterranean access tunnel adjacent a coal seam. Using such a system, adjacent boreholes may be drilled from the high wall bench or access tunnel into the coal seam.

However, scroll augers cannot be efficiently steered, and therefore such scroll augers tend to migrate into adjacent boreholes or out of the coal seam altogether. In addition, as the cutting head advances away from the drilling unit, more and more power is required to thrust by putting weight on the cutting head and for torque to turn the auger. For both of these reasons, the length of the borehole, and thus the length of a particular section of the coal seam actually mined, are typically limited to distances of less than three hundred feet. Therefore, numerous, expensive high wall benches or access tunnels may be required to mine a given seam of coal.

Cutting heads having both water jets and mechanical-type bits have also been utilized for a certain applications. Some of these cutting heads are typically used for the drilling of oil and gas wells. For example, U.S. Pat. No. 4,723,612 discloses a rotating diamond bit that has a cutting face including a plurality of cutters and nozzles. The nozzles direct water in a fan-like pattern that impinges directly onto the cutters, preventing the overheating or clogging of the cutters. U.S. Pat. No. 4,494,618 provides another example of a drill bit having diamond cutting elements and nozzles that are removable, replaceable, and self cleaning. As a further example, U.S. Pat. No. 3,645,346 discloses an erosion drilling system having at least two sets of high pressure water jet nozzles for primary cutting and to counteract nozzle erosion, and auxiliary cutting devices such as cone cutters, drag bit blades, or diamond head cutters.

Other ones of these cutting heads have been used for mining applications. For example, U.S. Pat. No. 4,733,914 discloses a rotating drum type cutting head having both cutter picks and nozzles for delivery of high pressure water to the cutter picks. U.S. Pat. No. 4,765,686 discloses a rotable cutting bit for a mining machine having a hard insert and nozzles for ejecting water from the bit.

U.S. Pat. No. 2,218,130 provides an example of a cutting head having both water jets and cutter blades used for the removal of solids, such as coke, from a vessel or oven. The water jets and cutter blades are used to drill successively larger diameters holes so as to "ream out" the solids from the vessel.

Despite the above-described conventional mining systems and cutting heads, a need still exists in the mining industry for a reliable cutting head that is capable of economically mining relatively thin, generally horizontal coal (or other mineral) seams. The introduction of high pressure fluid to complement and cut independently with the mechanical cutting bits allows a reduction of the size of the downhole electric motor and required mechanical horsepower. This is critical in thin seams to allow adequate clearance. Furthermore, introduction of high pressure fluid can allow delivery of sufficient horsepower for maximum penetration. In addition, a need also exists for a cutting head that provides improved cutting rates and navigation within relatively thin, generally horizontal coal seams. Furthermore, a need exists for a cutting head for a mining system that addresses the limitations of the above-described conventional cutting heads.

SUMMARY OF THE INVENTION

One aspect of the present invention comprises a cutting head for creating an excavation in a mineral seam. The cutting head includes a first body having a manifold for containing high pressure fluid and an axis of rotation generally parallel to the borehole, a first plurality of mechanical bits disposed on the first body, a first plurality of nozzles disposed around the axis of rotation for spraying the high pressure fluid, and a plurality of tubes fluidly coupling the manifold and the first plurality of nozzles. On supplying high pressure fluid to the manifold and rotating the cutting head about the axis of rotation, the nozzles create a generally circular, independent and, as appropriate, overlapping patterns of high pressure fluid jet arcs that cut in front of the cutting head. The pattern of high pressure fluid is directed to cut the borehole independently of the mechanical bits.

In another aspect, he present invention comprises a cutting head for creating an excavation in a mineral seam. The cutting head includes a first body having a manifold for containing high pressure fluid and an axis of rotation generally parallel to the borehole, a plurality of nozzles disposed around the axis of rotation for spraying the high pressure fluid, and a plurality of tubes fluidly coupling the manifold and the first plurality of nozzles. On supplying high pressure fluid to the manifold and rotating the cutting head about the axis of rotation, the nozzles create a generally circular, overlapping pattern of high pressure fluid in front of the cutting head. The pattern of high pressure fluid is directed to cut across substantially an entire face of the cutting head.

In a further aspect, the present invention comprises a method of creating an excavation in a mineral seam. A cutting head is provided. The cutting head has a manifold for containing high pressure fluid, an axis of rotation generally parallel to the borehole, a plurality of mechanical bits disposed at various radii around the axis of rotation, and a plurality of nozzles disposed at various radii around the axis of rotation for spraying the high pressure fluid. The cutting head is positioned proximate a mineral seam, and high pressure fluid is supplied to the manifold. The cutting head is then rotated about the axis of rotation to create a generally circular, overlapping pattern of high pressure fluid in front of the cutting head. The borehole is cut with the rotating pattern of high pressure fluid and the mechanical bits. The high pressure fluid cuts the borehole independently of the mechanical bits.

In a further aspect, the present invention comprises a method of creating an excavation in a mineral seam. A cutting head is provided. The cutting bead has a manifold for containing high pressure fluid, an axis of rotation generally parallel to the borehole, and a plurality of nozzles disposed at various radii around the axis of rotation for spraying the high pressure fluid. The cutting head is positioned proximate a mineral seam, and high pressure fluid is supplied to the manifold. The cutting head is rotated about the axis of rotation to create a generally circular, overlapping pattern of high pressure fluid in front of the cutting head and across substantially an entire face of the cutting head. The borehole is cut with the rotating pattern of high pressure fluid.

In a further aspect, the present invention comprises a cutting head system for creating an excavation in a mineral seam. The cutting head system includes a first cutting head having a manifold for containing high pressure fluid, an axis of rotation generally parallel to the borehole, a plurality of nozzles disposed at various radii around the axis of rotation for spraying the high pressure fluid, and a plurality of hollow tubes fluidly coupling the manifold and the first plurality of nozzles. The cutting head system further includes a second cutting head substantially identical to the first cutting head having a second axis of rotation generally parallel to the excavation, where the second cutting head is arranged in a generally linear fashion with the first cutting head. On supplying high pressure fluid to the manifolds, rotating the first cutting head about the axis of rotation, and rotating the second cutting head about the second axis of rotation, the nozzles on the first and second cutting heads create two adjacent, generally circular, overlapping patterns of high pressure fluid in front of the cutting heads for cutting the excavation with a generally oval-shape cross-section.

In a further aspect, the present invention comprises a cutting head system for creating an excavation in a mineral seam. The cutting head system includes a first cutting head having a manifold for containing high pressure fluid, an axis of rotation generally parallel to the excavation, a plurality of nozzles disposed at various radii around the axis of rotation for spraying the high pressure fluid, and a plurality of hollow tubes fluidly coupling the manifold and the first plurality of nozzles. The cutting head system further includes a second cutting head substantially identical to the first cutting head having a second axis of rotation generally parallel to the excavation, and a third cutting head substantially identical to the first cutting head having a third axis of rotation generally parallel to the excavation. The first, second, and third cutting heads are arranged in a generally triangular arrangement. On supplying high pressure fluid to the manifolds, rotating the first cutting head about the axis of rotation, rotating the second cutting; head about the second axis of rotation, and rotating the third cutting head about the third axis of rotation, the nozzles on the first, second, and third cutting heads create three generally circular, overlapping patterns of high pressure fluid in front of the cutting heads and for cutting the excavation with a generally pie-shaped cross-section.

BRIEF DESCRIPTION OF THE DRAWINGS

For a more complete understanding of the present invention, and for further objects and advantages thereof, reference is made to the following description taken in conjunction with the accompanying drawings in which.

DETAILED DESCRIPTION OF THE PREFERRED EMBODIMENTS

The preferred embodiments of the present invention and its advantages are best understood by referring to FIGS. 1–11 of the drawings, like numerals being used for like and corresponding parts of the various drawings.

Figure 1:
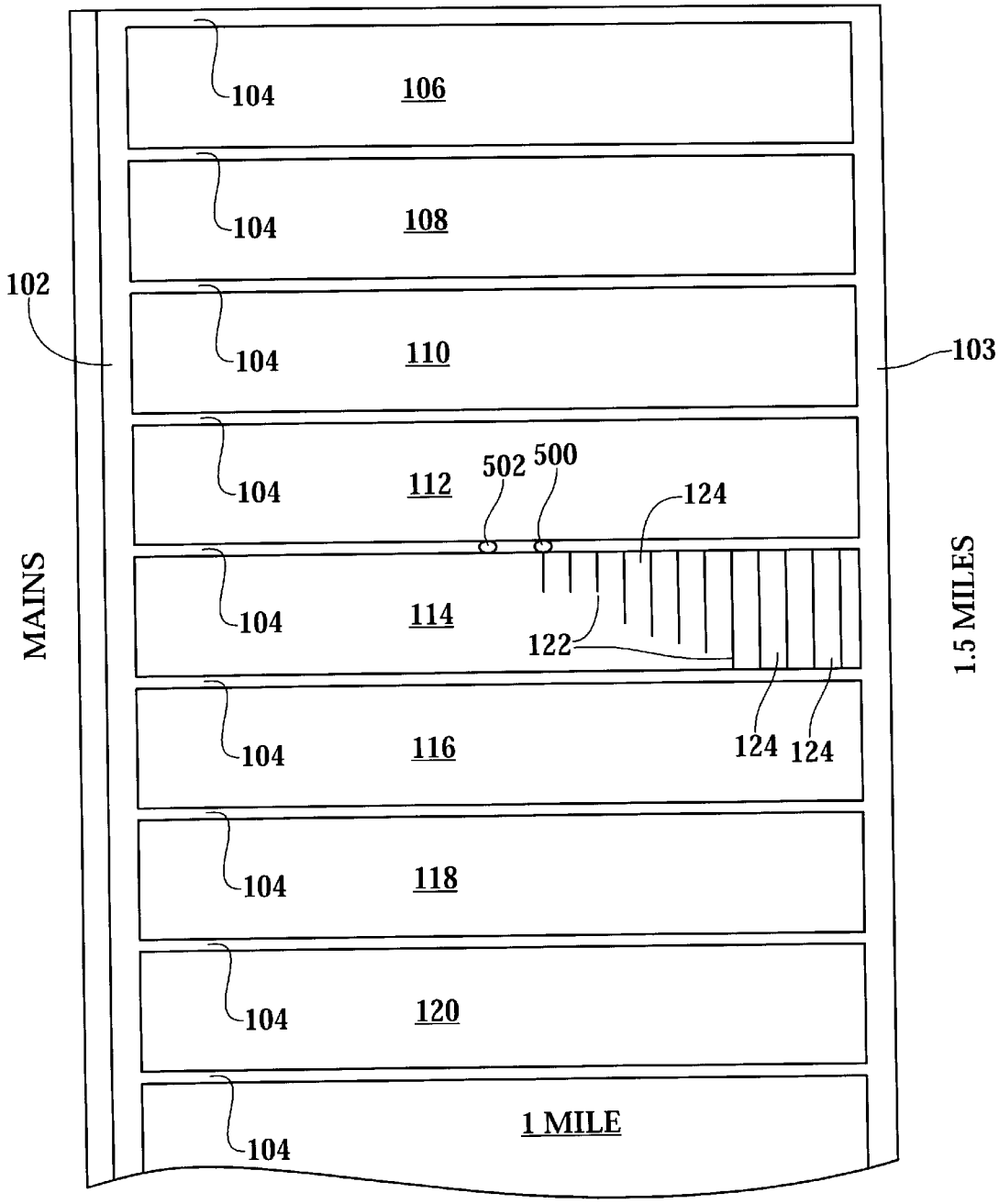
FIG. 1 is a schematic, top view of a defined area for horizontal mining operations.

Referring now to FIG. 1, there is shown a schematic, top view of a defined area 100 for horizontal mining operations. Area 100 may comprise a mineral deposit of relatively thin proportions, perhaps on the order of 1 to 10 feet in thickness, and more typically on the order of 2 to 6 feet in thickness. Minerals such as coal in such thin seams can be difficult to mine in an economical fashion with conventional technology. For that reason, the present invention, as described hereinbelow, affords a marked improvement over the prior art.

As shown in FIG. 1, defined area 100 comprises a region of approximately 1 mile by 1.5 miles in size. This area is preferably only a portion of a larger mineral deposit for which mining is desired. An outcrop of a coal sewn to ground level, or one or more vertical shafts or horizontal slopes (not shown), provide access from ground level to a subterranean main entries 102 or a subterranean nun entries 103. A plurality of access entries 104 are formed between main entries 102 and 103 for defining smaller excavation regions 106, 108, 110, 112, 114, 116, 118, and 120, each of which is preferably approximately one mile long and 1000 feet wide. Access entries 104 are preferably on the order of 15 to 20 feet each wide and 1 to 10 feet high, the thickness of the coal seam. A plurality of holes 122 are formed transversely through region 114 by the cutting heads of the present invention, the preferred embodiments of which are shown in FIGS. 2–7. Each of holes 122 are preferably generally circular in cross-section and have a diameter equal to the approximate thickness of the coal seam. Although not shown in FIG. 1, boreholes similar to boreholes 122 may be formed in each of excavation regions 106–120. As shown in FIG. 1, according to the present invention boreholes 122 may extend the entire distance between adjacent access tunnels, or boreholes 122 may alternatively extend only part of this distance. Boreholes 122 are formed in a generally parallel relationship to one another, and a web of coal 124 is located between adjacent bore holes. Webs 124 preferably have a generally "hour glass" shape, and each web 124 preferably has a width, measured at its minimum dimension along its centerline, of approximately 0.5 to two (2) feet.

Figure 2:
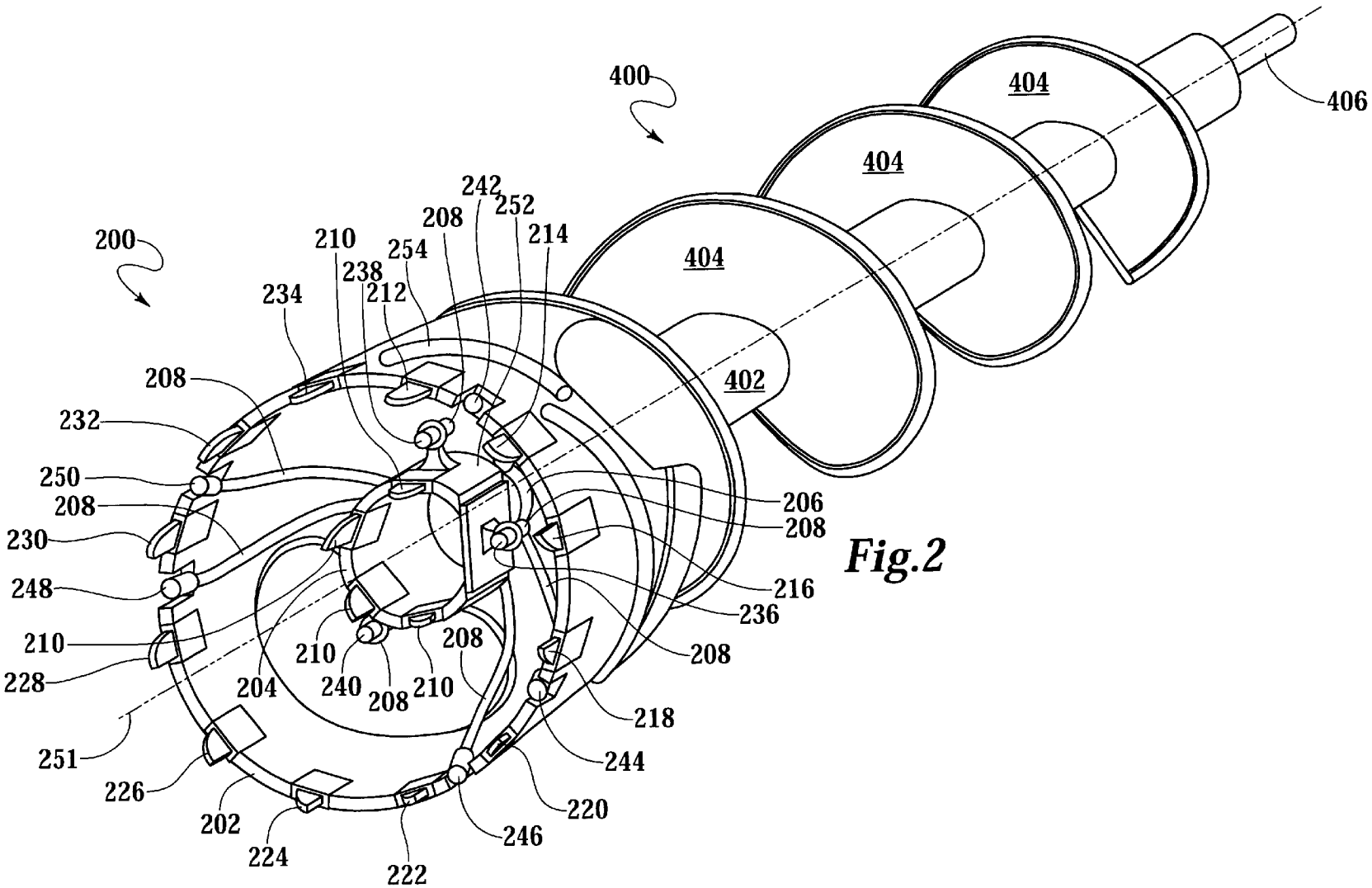
FIG. 2 is a perspective view of a first preferred embodiment of a water jet/mechanical cutting head for a horizontal remote mining system according to the present invention.
Figure 3:
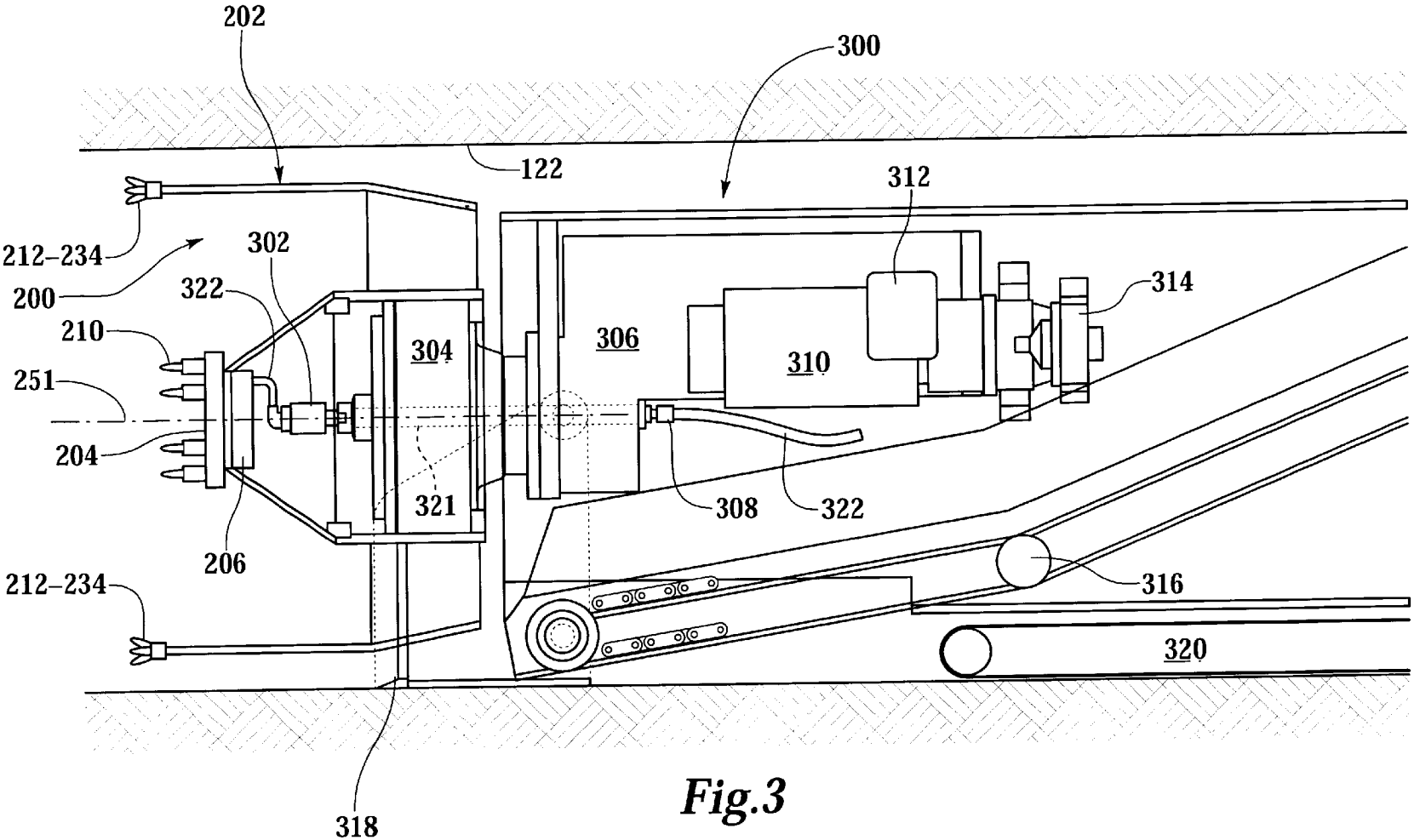
FIG. 3 is a schematic, side, sectional, fragmentary view of the cutting head of FIG. 2 connected to a preferred chassis.

Referring now to FIGS. 2 and 3 in combination, a preferred embodiment of a cutting head 200 for a horizontal remote mining system is shown in greater detail. Cutting head 200, as well as the other preferred embodiments of cutting heads shown in FIGS. 4 through 7, may be used in a horizontal remote mining system, such as, by way of example, the systems disclosed in above-referenced U.S. application Ser. No. 08/745,459, which issued as U.S. Pat.

No. 5,879,057 on Mar. 9, 1999, U.S. Provisional Application No. 60/079,835, and U.S. Provisional Application No. 60/079,941. The cutting heads disclosed in FIGS. 2 through 7 may also be used in other similar horizontal remote mining systems, or in conventional mining systems.

As shown in FIG. 2, cutting head 200 generally includes an outer body 202, a core breaker 204, a manifold 206, and a plurality of hollow tubes 208 extending from manifold 206 and for conveying water therein. A plurality of mechanical bits, or cutters, 210 are located on core breaker 204. A plurality of mechanical bits, or cutters, 212–234 are located on outer body 202. Hollow tubes 208 terminate in water jet nozzles 236–250.

As shown in FIG. 2, cutting head 200 is shown connected to an auger body 400. Auger body 400 includes a hollow shaft 402 and a plurality of generally helical screw turns 404 extending from shaft 402. Hollow shaft 402 terminates in a rear end 406. Rear end 406 may be used to couple successive portions of auger body 400 together as cutting head 200 advances into borehole 122. The rear end 406 of the auger body 400 closest to access entry 104 is rotatably coupled to a conventional auger drill unit 500 located in access tunnel 104 (FIG. 1). Auger drill unit 500 rotates auger body 400 and cutting head 200, preferably at a rate of about 50–100 rpm. A high pressure water source 502 located in access entry 104, main entries 102 or 103, or at ground level (FIG. 1) delivers water to manifold 206 via hollow shaft 406 or a high pressure water hose located therein.

Referring now to FIG. 3, cutting head 200 is shown connected to a preferred chassis 300, instead of auger body 400. Hollow tubes 208 and nozzles 236–250 are not shown in FIG. 3 for clarity of illustration. Chassis 300 preferably includes a high pressure water swivel 302, a planetary 304, a gear assembly 306, a second high pressure water swivel 308, a first electric motor 310, a second electric motor 312, a hydraulic pump 314, a conveyor 316, a scoop 318, and a crawler 320.

First electric motor 310 rotates cutting head 200 via gear assembly 306 and planetary 304. Gear assembly 306 transfers rotary power from a shaft of first electric motor 310 to a hollow shaft 321 of planetary 304. Planetary 304 reduces the rpm of electric motor 310 to the desired rpm of the cutting head 200, for example from about 1750 rpm to about 50–100 rpm. A high pressure water hose 322 connects to both ends of hollow shaft 321 via high pressure water swivels 302 and 308. Swivels 302 and 308 prevent hose 322 from twisting and allows both torque and weight to be transmitted to cutting head 200. High pressure water hose 322 also delivers water from high pressure water source 502 to manifold 206 of cutting head 200. Planetary 304 may be made by modifying a conventional planetary or similar speed reducer, such as the torque hub sold by Fairfield of Lafeyette, Ind., to include hollow shaft 321 so as to be able to deliver high pressure water.

Second electric motor 312 powers hydrauic pump 314. Hydraulic pump 314 may be used to power conveyor 316, crawler 320, or other apparatus on a horizontal remote mining system of which cutting head 200 is a component. Crawler 320 is preferably of the conventional variety having dual rotating treads for moving cutting head 200 and chassis 300 in and out of borehole 122. Of course, planetary 304, gear assembly 306, electric motor 310, and crawler 320 eliminate the need for the conventional auger drill unit 500. More detail regarding a chassis for a remote mining system similar to chassis 300 is found in the above-referenced U.S. Provisional Application No. 60/093,357.

Referring again to FIG. 2, mechanical bits 210–234 and nozzles 236–250 are described in greater detail. Mechanical bits 210–234 are preferably steel with tungsten carbide cutters used in conventional scroll auger such as the cutters sold by Kennametal of Bedford, Pa. Selected ones of mechanical bits 210–234 are preferably oriented straight ahead, or parallel to, the axis of rotation 251 of cutting head 200, and other ones of mechanical bits 210–234 are angled inward or outward from such axis. Preferably, mechanical bits 210 alternate in an angled inward, then angled outward, pattern around core breaker 204 in identical angles of less 10 degrees from axis of rotation 251. As shown in FIG. 2, mechanical bits 212–234 preferably alternate in a straight ahead, angled inward, angled outward repeating pattern, in identical angles of less than about 10 degrees from axis of rotation 251, around outer body 202. Of course, cutting head 200 may be formed with different numbers and angular orientations of mechanical bits for specific applications.

Nozzles 236–250 are preferably conventional water jet nozzles, such as the nozzles sold by StoneAge of Durango, Colo. As shown in FIG. 2, nozzles 236–250 are located at various radial distances within outer body 202. More specifically, nozzle 236 is preferably located proximate an outer surface 252 of core breaker 204, nozzles 238 and 240 are preferably located between outer surface 252 and outer body 202, and nozzles 242 through 250 are preferably located proximate outer body 202. Nozzle 236 is preferably angled inward, and each of nozzles 238 through 250 is preferably positioned relative to axis of rotation 251, at a different angle of between about zero degrees and about thirty degrees. Therefore, upon rotation of cutting head 200, water ejected from nozzles 236–250 cuts a larger diameter hole than mechanical bits 212–234 located on outer body 202. In addition, upon rotation of cutting head 200, water ejected from nozzles 236–250 cuts across substantially the entire face of cutting head 200, from core breaker 204 to beyond outer body 202. Of course, cutting head 200 may be formed with different numbers and angular orientations of water jet nozzles for specific applications.

By way of example, in a cutting head 200 having an outer body 202 with a diameter of twenty-four inches, mechanical bits 210 may be angled inward and/or outward from axis of rotation 251. Mechanical bits 212, 218, 224, and 230, which point straight ahead, have tips located about 11.8 inches from axis of rotation 251. Mechanical bits 214, 220, 226, and 232, which are angled inward, have tips located about 10.3 inches from axis of rotation 251. Mechanical bits 216, 222, 228, and 234, which are angled outward, have tips located about 13.3 inches from axis of rotation 251. Nozzle 236 may be located about 3.6 inches from axis of rotation 251 and be angled inward relative to axis of rotation 251 at an angle of about fifteen degrees; nozzle 238 may be located about 5.6 inches from axis of rotation 251 and be pointed straight ahead; nozzle 240 may be located about 6.3 inches from axis of rotation 251 and be angled outward relative to axis of rotation 251 at an angle of about fifteen degrees; nozzle 242 may be located about 11.5 inches from axis of rotation 251 and be angled outward relative to axis of rotation 251 at an angle of about 11.3 degrees; nozzle 244 may be located about 11.6 inches from axis of rotation 251 and be angled outward relative to axis of rotation 251 at an angle of about 23.0 degrees; nozzle 246 may be located about 10.6 inches from axis of rotation 251 and be pointed straight ahead; nozzle 248 may be located about 11.6 inches from axis of rotation 251 and be angled outward relative to axis of rotation 251 at an angle of about 20.6 degrees; and nozzle 250 may be located about 10.6 inches from axis of rotation 251 and be pointed straight ahead. It is believed that these preferred dimensions may be extrapolated for a cutting head 200 having an outer body 202 with a thirty-six inch, forty-eight inch, or larger diameter.

Alternatively, although not shown in FIG. 2, nozzles 236, 238, and 240 may be located proximate outer body 202, so that all eight nozzles are positioned between mechanical bits 212–234 on outer body 202. In this alternate embodiment, selected ones of nozzles 236–250 are preferably angled inward relative to axis of rotation 251, other ones of nozzles 236–250 preferably point straight ahead, and still other ones of nozzles 236–250 are preferably angled outward relative to axis of rotation 251.

Having described the preferred structure of cutting head 200, its operation to mine a relatively thin, generally horizontal coal seam is now described in greater detail. Referring to FIG. 1, a horizontal remote mining system having a cutting head 200 is deployed in the access tunnel 104 adjacent excavation region 114. If a conventional auger drill unit 500 is being utilized to rotate and move cutting head 200, as described above, auger drill unit 500 is positioned at the correct location for drilling a first borehole 122. Cutting head 200 is then rotated by auger drill unit 500, or by electric motor 310 of chassis 300, preferably at a speed of between about 50 rpm to about 100 rpm. A wear ring 254 is preferably disposed on outer body 202. Wear ring 254 supports outer body 202 slightly above the floor of borehole 122 and facilitates the cutting by water jet nozzles 236–250 and rotation of cutting head 200. High pressure water source 502 delivers high pressure water to manifold 206 via hollow shaft 406, or via high pressure water swivels 302 and 308, hollow shaft 321, and high pressure hose 322. Such high pressure water is preferably delivered at about 3000 psi to about 10,000 psi and at about 50 gallons per minute to about 250 gallons per minute, and more preferably at about 6000 psi and about 150 gallons per minute. Optimal water quantity used is based on the moisture content of produced material. Specifically, more fluid will increase production but may also increase moisture content. It is preferable to maintain the moisture content of produced material to less than 15%. In this regard convention conveyor techniques can then be utilized. Nozzles 236–250 create a generally circular, overlapping pattern of high pressure water on the surface of excavation region 114. Cutting head 200 is then advanced toward excavation region 114, via auger drill unit 500 or crawler 320, until mechanical bits 210–234 began to cut coal.

Due to the positioning and sizing of nozzles 236–250 within cutting head 200, preferably about sixty to about seventy percent of the water is ejected in the area proximate outer body 202. Water ejected from nozzles 242–250 and mechanical bits 212–234 generally create perimeter of borehole 122, and water ejected from nozzles 236–240 and mechanical bits 210 generally "break up" the coal or other minerals created by borehole 122. Significantly, water ejected from nozzles 236–250 preferably cuts independently of mechanical bits 210–234. In other words, the generally circular, overlapping pattern of high pressure water created by nozzles 236–250 is preferably not directed toward any of mechanical bits 210–234. Therefore, the water ejected from nozzles 236–250 preferably cuts independently of mechanical bits 210–234 and is preferably not used to cut mined material in conjunction with the bits, or to cool or clean the bits.

As the high pressure water and mechanical bits 210–234 cut through excavation region 114, a slurry of water and coal particles drop to the floor of borehole 122. This slurry is carried away from cutting head 206 by helical screw turns 404 of auger body 400, or by conveyor 316 and scoop 318 of chassis 300 and a conventional conveyor driven coal conveyance system (not shown) cooperating with the rear end of conveyor 316. As borehole 122 lengthens, additional sections of auger body 400, or additional sections of such a conventional coal conveyance system, are added as required. In this way, the water and coal slurry continues to be conveyed from cutting head 200 to the bead of borehole 122 in access tunnel 104. In addition, a conventional auger drill unit 500, or a crawler 320, keeps cutting head 200 in close proximity to the coal face at the end of borehole 122. Once at the head of borehole 122, the coal is collected and transported to ground level using conventional means, such as a belt conveyor. Additional boreholes 122 may be formed in a generally parallel fashion in excavation region 114, and the corresponding coal may be removed, by repeating the above-described process.

Cutting head 200 provides significant advantages over conventional mechanical, hydraulic, and mechanical/hydraulic cutting heads. For example, it has been determined that using mining system 200, boreholes 122 may be accurately formed in a generally parallel fashion within excavation region 114 in lengths of up to 500–1000 feet. This increased length represent substantial improvement over the three hundred foot maximum length of boreholes 122 formed using a conventional scroll auger. This increased length also significantly reduces the cost of mining defined area 100 by reducing the number of expensive access tunnels 104 that would be required if the maximum length of boreholes 122 was three hundred feet.

In addition, cutting head 200 provides improved ability to maintain itself within a coal seam, as compared to such conventional cutting heads. More specifically, as water ejected from nozzles 236–250 cuts a larger diameter hole than mechanical bits 212–234 located on outer body 202, and as water pressure to nozzles 236–250 may be controlled so that it is high enough to cut coal (or other minerals) but not the solid rock that bowers the floor and ceiling of a mineral seam, cutting head 200 automatically stays within the mineral seam.

Furthermore, it has been determined that cutting head 200 provides significantly higher coal cutting rates as compared to such conventional cutting heads. For example, in soft coals, cutting head 200 using high pressure water at about 6000 psi and 150 gallons per minute achieves a penetration rate of approximately 20 feet/minute during development of a 30" hole, as compared to approximately 10–12 feet/minute for a conventional scroll auger. In hard coals, cutting head 200 using high pressure water at about 6000 psi and 150 gallons per minute achieves a penetration rate of approximately 12 feet/minute, as compared to approximately 8 feet/minute for a conventional scroll auger. It is believed that such improved cutting rates are at least partially attributable to the fact that water ejected from nozzles 236–250 preferably cuts independently of mechanical bits 210–234.

Still further, unlike conventional hydraulic cutting heads, mechanical bits 210–234 allow cutting head 200 to cut through rock strata within the interior of, but not on the floor or ceiling of, borehole 122. In addition, due to the presence of mechanical bits 210–234, cutting head 200 requires less water than conventional hydraulic systems. This in turn reduces the amount of, or eliminates the need for, the expensive dewatering processes required by some conventional, hydraulic systems.

Figure 4:
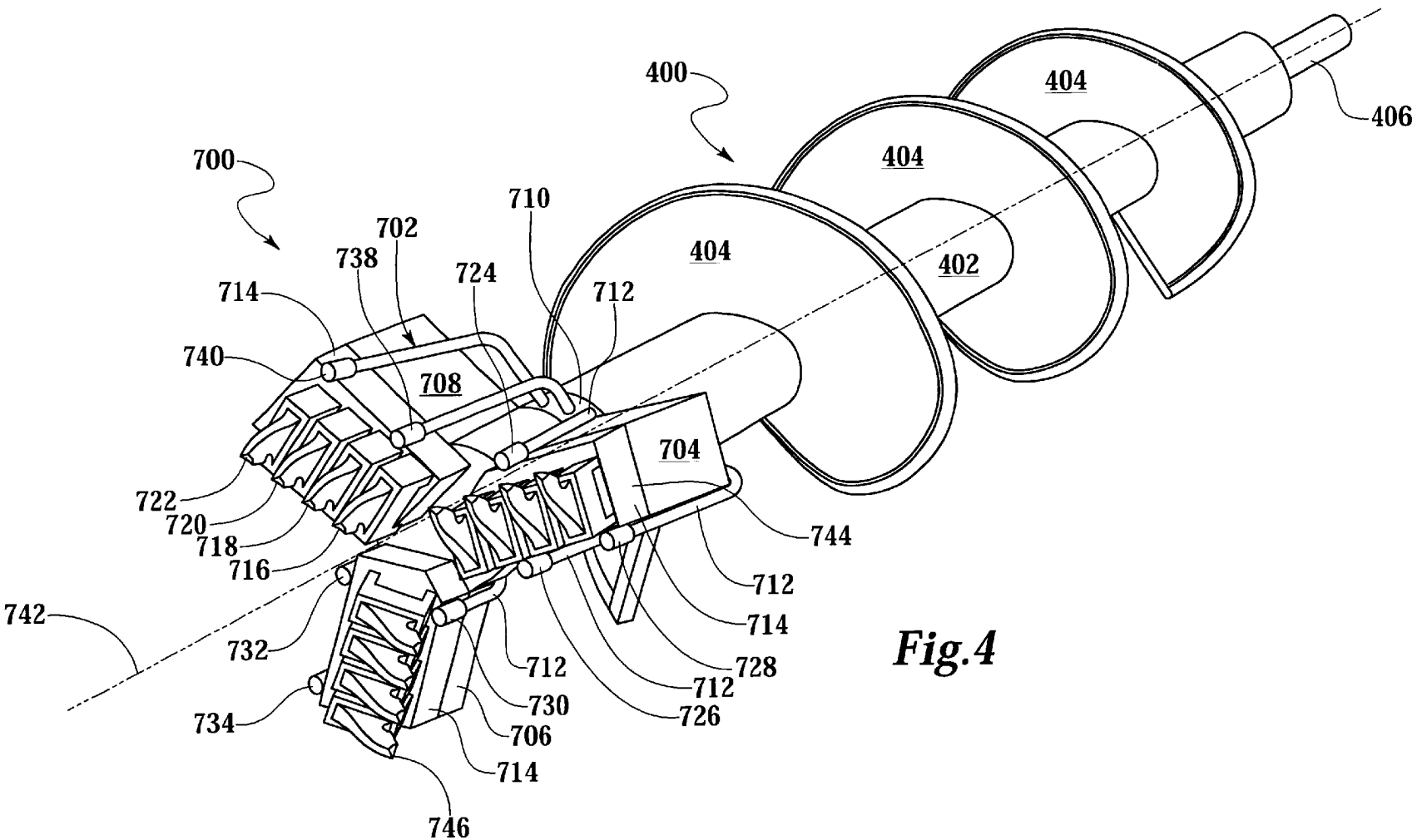
FIG. 4 is a perspective view of a second preferred embodiment of a water jet/mechanical cutting head for a horizontal remote mining system according to the present invention.

Referring now to FIG. 4, a preferred embodiment of a cutting head 700 for a horizontal remote mining system is shown in greater detail. As shown in FIG. 4, cutting head 700 is operatively coupled to auger body 400, as described hereinabove in connection with cutting head 200 in FIG. 2. However, cutting head may also be operatively coupled to chassis 300, as described hereinabove in connection with cutting head 200 in FIG. 3.

Cutting head 700 generally includes a "Y-shaped" frame 702 having three arms, 704, 706, and 708 with a spacing of about 120 degrees; a manifold 710; and a plurality of hollow tubes 712 extending from manifold 710 and for conveying water therein. Each of arms 704, 706, and 708 has a bit block 714 removably coupled thereto. Each bit block 714 has mechanical bits or cutters 716–722 located thereon. Hollow tubes 712 terminate in water jet nozzles 724–740. Nozzles 724, 726, and 728 are associated with arm 704; nozzles 730, 732, and 734 are associated with arm 706; and nozzles 736 (not visible in FIG. 4), 738, and 740 are associated with arm 708. Although not shown in FIG. 4, cutting head 700 may be formed with longer bit blocks 714 having more mechanical bits, and/or more water jet nozzles, if it is desired to cut larger diameter boreholes 122.

Cutting head 700 may be coupled to, rotated by, and moved in and out of borehole 122 by auger body 400 in substantially the same manner as cutting head 200. Alternatively, cutting head 700 may be coupled to, rotated by, and moved in and out of borehole 122 by chassis 300 in substantially the same manner as cutting head 200. Mechanical bits 716, 718, 720, and 722 are preferably identical in structure to mechanical bits 210–234 of cutting head 200, and nozzles 724–740 are preferably identical in structure to nozzles 236–250 of cutting head 200.

Each of mechanical bits 716–722 are preferably oriented straight ahead with respect to an axis of rotation 742 of cutting head 700, and are preferably disposed at evenly spaced radial distances between axis of rotation 742 and an outer surface 744 of bit block 714. For example, in a cutting head 700 having about a twenty-two inch diameter, mechanical bits 716 are preferably located about 2.6 inches from axis of rotation 742; mechanical bits 718 are preferably located about 5.4 inches from axis of rotation 742; mechanical bits 720 are preferably located about 8.1 inches from axis of rotation 720; and mechanical bits 722 are preferably located about 10.9 inches from axis of rotation 742. Nozzles 724–740 are located at various radial distances between axis of rotation 742 and outer surface 744. More specifically, nozzles 724 and 730 are preferably located at a radial distance proximate mechanical bits 716; nozzles 726, 732, and 738 are preferably located at a radial distance between bits 718 and 720; and nozzles 728, 734, 736, and 740 are preferably located at a radial distance proximate bits 722. Nozzles 724 and 730 are preferably angled inward; nozzles 726, 732, and 738 are preferably angled outward; and nozzles 728, 734, 736, and 740 are preferably angled outward relative to axis of rotation 742 at a different angle of less than about thirty degrees. Nozzles 724, 730, and 736 are preferably located on the same side of bit block 714 as tips 746 of mechanical bits 716–722, and nozzles 726, 728, 732, 734, 738, and 740 are preferably located on the opposite side of bit block 714 as tips 746 of mechanical bits 716–722. Upon rotation of cutting bead 700, water ejected from nozzles 724–740 cut a larger diameter hole than mechanical bits 716–722 located on frame 702. In addition, upon rotation of cutting head 700, water ejected from nozzles 724–740 cuts across substantially the entire face of cutting head 700, from axis of rotation 742 to beyond outer surface 744 of bit blocks 714. Of course, cutting head 700 may be formed with different numbers and angular orientations of water jet nozzles for specific applications.

Cutting head 700 may be used to mine a relatively thin, generally horizontal coal seam in a substantially similar manner to that described above in connection with cutting head 200. When cutting head 700 is rotated and supplied with high pressure water to manifold 710, nozzles 724–740 create a generally circular, overlapping pattern of high pressure water on the surface of excavation region 114. Cutting head 700 is then advanced toward excavation region 114, via an auger drill unit 500 or a crawler 320, until mechanical bits 716–722 of frame 702 began to cut coal.

Due to the positioning and sizing of nozzles 724–740 within cutting head 700, preferably about sit to about seventy percent of the water is ejected in the area proximate outer surface 744 of bit blocks 714. Significantly, water ejected from nozzles 724–740 preferably cuts independently of mechanical bits 716–722 on frame 702.

Cutting head 700 provides the same, significant advantages over conventional mechanical, hydraulic, and mechanical/hydraulic cutting heads as described above in connection with cutting head 200. More specifically with respect to coal cutting rates, in soft coals, cutting head 700 using high pressure water at about 6000 psi and 150 gallons per minute achieves a penetration rate of approximately 20 feet/minute during development of a 30" hole, as compared to approximately 10–12 feet/minute for a conventional scroll auger. In hard coals, cutting head 700 using high pressure water at about 6000 psi and 150 gallons per minute achieves a penetration rate of approximately 14 feet/minute, as compared to approximately 8 feet/minute for a conventional scroll auger. Therefore, cutting head 700 works particularly well in hard coals or other similar minerals. It is believed that such improved cutting rates are at least partially attributable to the fact that water ejected from nozzles 724–740 preferably cuts independently of mechanical bits 716 722.

Figure 5:
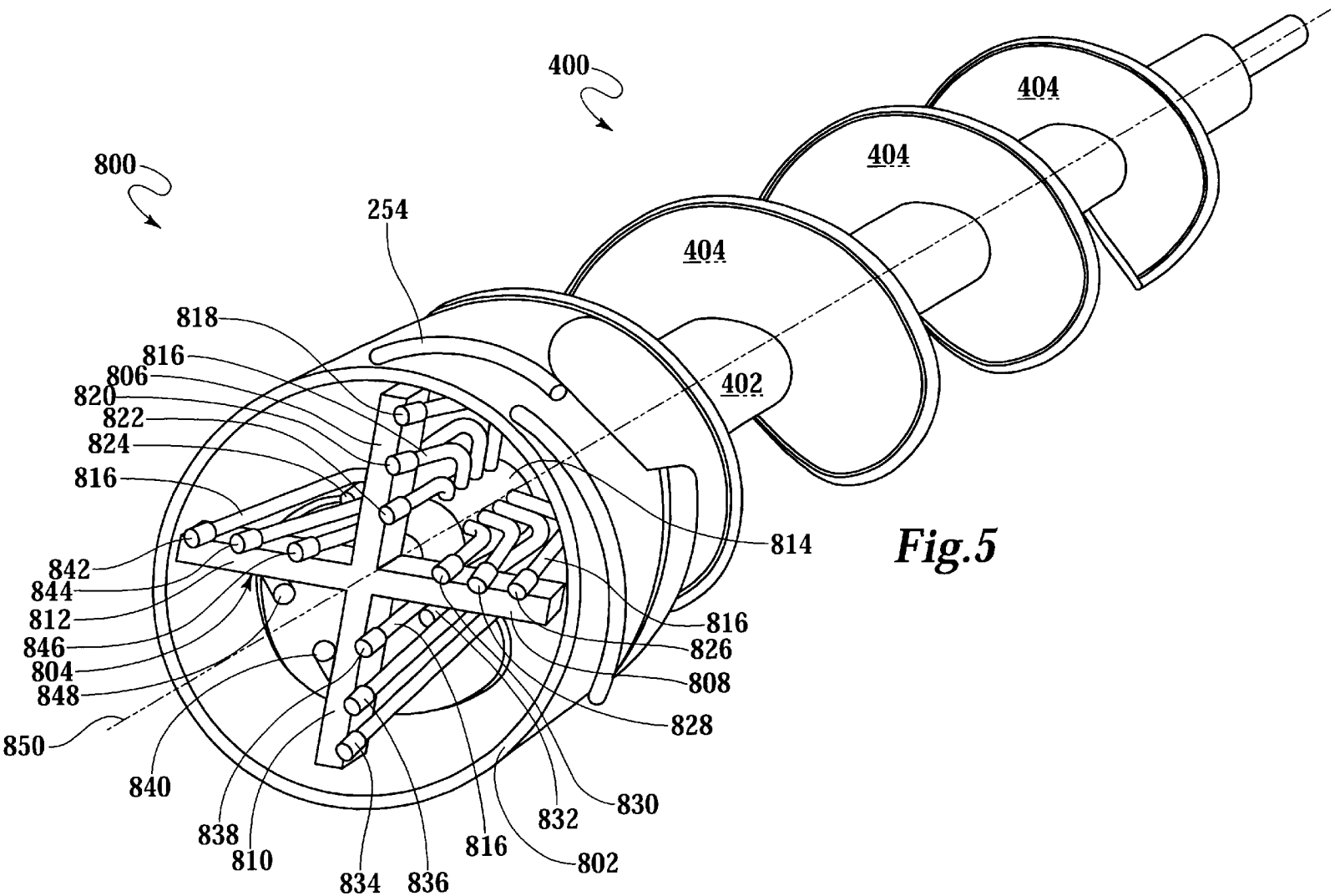
FIG. 5 is a perspective view of a third preferred embodiment of a water jet cutting head for a horizontal remote mining system according to the present invention.
Figure 6:
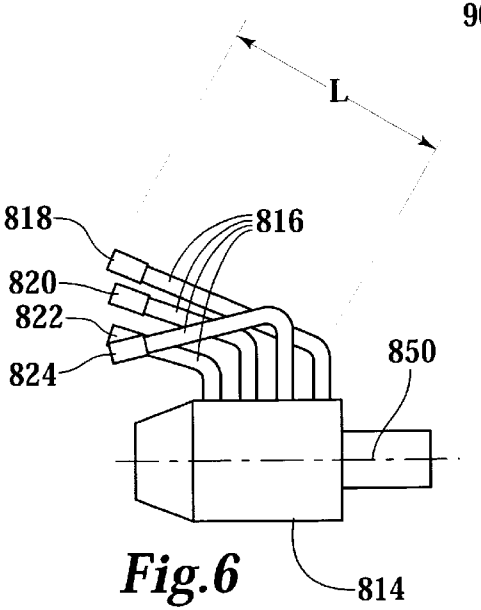
FIG. 6 is a schematic, side, fragmentary view of one of the arms of the cutting head of FIG. 5.

Referring now to FIGS. 5 and 6 in combination, a preferred embodiment for a cutting head 800 for a horizontal remote mining system is shown in greater detail. As shown in FIG. 5, cutting head 800 is operatively coupled to auger body 400, as described hereinabove in connection with cutting head 200 in FIG. 2. However, cutting head 800 may also be operatively coupled to chassis 300, as described hereinabove in connection with cutting head 200 in FIG. 3.

Cutting head 800 generally includes an outer body 802; an "X"-shaped frame assembly 804 having four arms 806, 808, 810, and 812 with a spacing of about 90 degrees and disposed within outer body 802; a manifold 814; and a plurality of hollow tubes 816 extending from manifold 814 and for conveying water herein. Hollow tubes 816 terminate in water jet nozzles 818–848. Nozzles 818–824 are associated with arm 806, nozzles 826–832 are associated with arm 808, nozzles 834–840 are associated with arm 810, and nozzles 842–848 are associated with arm 812.

Cutting head 800 may be coupled to, rotated by, and moved in and out of borehole 122 by auger body 400 in substantially the same manner as cutting head 200. Alternatively, cutting head 800 may be coupled to, rotated by, and moved in and out of borehole 122 by chassis 300 in substantially the same manner as cutting head 200. Water jet nozzles 818–848 are preferably identical in structure to nozzles 236–250 of cutting head 200.

Nozzles 818–848 are located at various radial distances between an axis of rotation 850 of cutting head 800 and outer body 802. More specifically, a first group of nozzles 818, 826, 834, and 842 are preferably located at similar radial distances proximate outer body 802; a second group of nozzles 820, 828, 836, and 844 are preferably located at radial distances proximate to, but interior of, the first group of nozzles; a third group of nozzles 822, 830, 838, and 846 are preferably located at similar radial distances proximate to, but interior of, the second group of nozzles; and a fourth group of nozzles 824, 832, 840, and 848 are preferably located at similar radial distances interior of the third group of nozzles and proximate an exterior surface 852 of manifold 814. Within the first group, individual ones of nozzles 818, 826, 834, and 842 are preferably angled outward relative to axis of rotation 850 at an angle of less than about twenty-five degrees. Within the second group, individual ones of nozzles 820, 828, 836, and 844 are preferably angled outward relative to axis of rotation 850 at an angle of less than about twenty degrees. Within the third group, individual ones of nozzles 822, 830, 838, and 846 are preferably angled outward relative to axis of rotation 850 at an angle of less than about twenty degrees. Within the fourth group, individual ones of nozzles 824, 832, 840, and 848 are preferably angled inward relative to axis of rotation 850 at an angle between about zero and twenty degrees. Therefore, upon rotation of cutting head 800, water ejected from nozzles 818–848 cut a larger diameter hole than the diameter of outer body 802. In addition, upon rotation of cutting head 800, water ejected from nozzles 818–848 cuts across substantially the entire face of cutting head 800, from axis of rotation 850 to beyond outer body 802. Of course, cutting head 800 may be formed with different numbers and angular orientations of water jet nozzles for specific applications.

FIG. 6 shows a detailed, side, fragmentary view of manifold 814, nozzles 818–824 of arm 806; and the individual ones of tubes 816 that are coupled to nozzles 818–824. The straight length "L" of hollow tube 816 coupled to nozzle 818 is preferably at least about fifty to about 100 times the diameter of nozzle 818 from axis of rotation 850. It is believed that such design decreases the turbulence of the water emitted from nozzle 818 and increases the cutting power of such water. Each of tubes 816 within cutting head 800 are preferably formed in a similar manner.

By way of example, in a cutting head 800 having an outer body 802 with a diameter of twenty-four inches, nozzle 818 may be located about 11.0 inches from axis of rotation 850 and be angled outward relative to axis of rotation 850 at an angle of about 23 degrees; nozzle 826 may be located about 10.9 inches from axis of rotation 850 and be angled outward relative to axis of rotation 850 at an angle of about 18 degrees; nozzle 834 may be located about 11.4 inches from axis of rotation 850 and be angled outward relative to axis of rotation 850 at an angle of about twenty degrees; and nozzle 842 may be located about 11.0 inches from axis of rotation 850 and be angled outward relative to axis of rotation 850 at an angle of about sixteen degrees. Nozzle 820 may be located about 9.2 inches from axis of rotation 850 and be angled outward relative to axis of rotation 850 at an angle of about 19 degrees; nozzle 828 may be located about 8.3 inches from axis of rotation 850 and be angled outward relative to axis of rotation 850 at an angle of about 17 degrees; nozzle 836 may be located about 8.8 inches from axis of rotation 850 and be angled outward relative to axis of rotation 850 at an angle of about 19 degrees; and nozzle 844 may be located about 8.4 inches from axis of rotation 850 and be angled outward relative to axis of rotation 850 at an angle of about 15 degrees. Nozzle 822 may be located about 6.8 inches from axis of rotation 850 and be angled outward relative to axis of rotation 850 at an angle of about 16 degrees; nozzle 830 may be located about 5.7 inches from axis of rotation 850 and be angled outward relative to axis of rotation 850 at an angle of about 11 degrees; nozzle 838 may be located about 7.1 inches from axis of rotation 850 and be angled outward relative to axis of rotation 850 at an angle of about 15 degrees; and nozzle 846 may be located about 6.3 inches from axis of rotation 850 and be angled outward relative to axis of rotation 850 at an angle of about 10 degrees. Nozzle 824 may be located about 5.9 inches from axis of rotation 850 and be angled inward relative to axis of rotation 850 at an angle of about 13 degrees; nozzle 832 may be located about 4.4 inches from axis of rotation 850 and be angled inward from axis of rotation 850 at an angle of about 20 degrees; nozzle 840 may be located about 6.6 inches from axis of rotation 850 and be angled inward relative to axis of rotation 850 at an angle of about 0 degrees; and nozzle 848 may be located about 6.2 inches from axis of rotation 850 and be angled inward relative to axis of rotation 850 at an angle of about 5 degrees. It is believed that these preferred dimensions may be extrapolated for a cutting head 800 having an outer body 802 with a thirty-six inch, forty-eight inch, or larger diameter.

Cutting head 800 may be used to mine a relatively thin, generally horizontal coal seam in a substantially similar manner to that described above in connection with cutting head 200. When cutting head 800 is rotated and supplied with high pressure water to manifold 814, nozzles 818–848 create a generally circular, overlapping pattern of high pressure water on the surface of excavation region 114. Due to the positioning and sizing of nozzles 818–848 within cutting head 800, preferably about sixty to about seventy percent of the water is ejected in the area proximate outer body 802. Cutting head 800 is then advanced toward excavation region 114, via auger drill unit 500 or crawler 320, as borehole 122 deepens.

Cutting head 800 provides the same, significant advantages over conventional mechanical, hydraulic, and mechanical/hydraulic cutting heads as described above in connection with cutting head 200. More specifically with respect to coal cutting rates, in soft coals, cutting head 800 using high pressure water at about 6000 psi and 150 gallons per minute, developing a 30" diameter borehole achieves a penetration rate of approximately 16 feet/minute, as compared to approximately 10–12 feet/minute for a conventional scroll auger.

Figure 7:
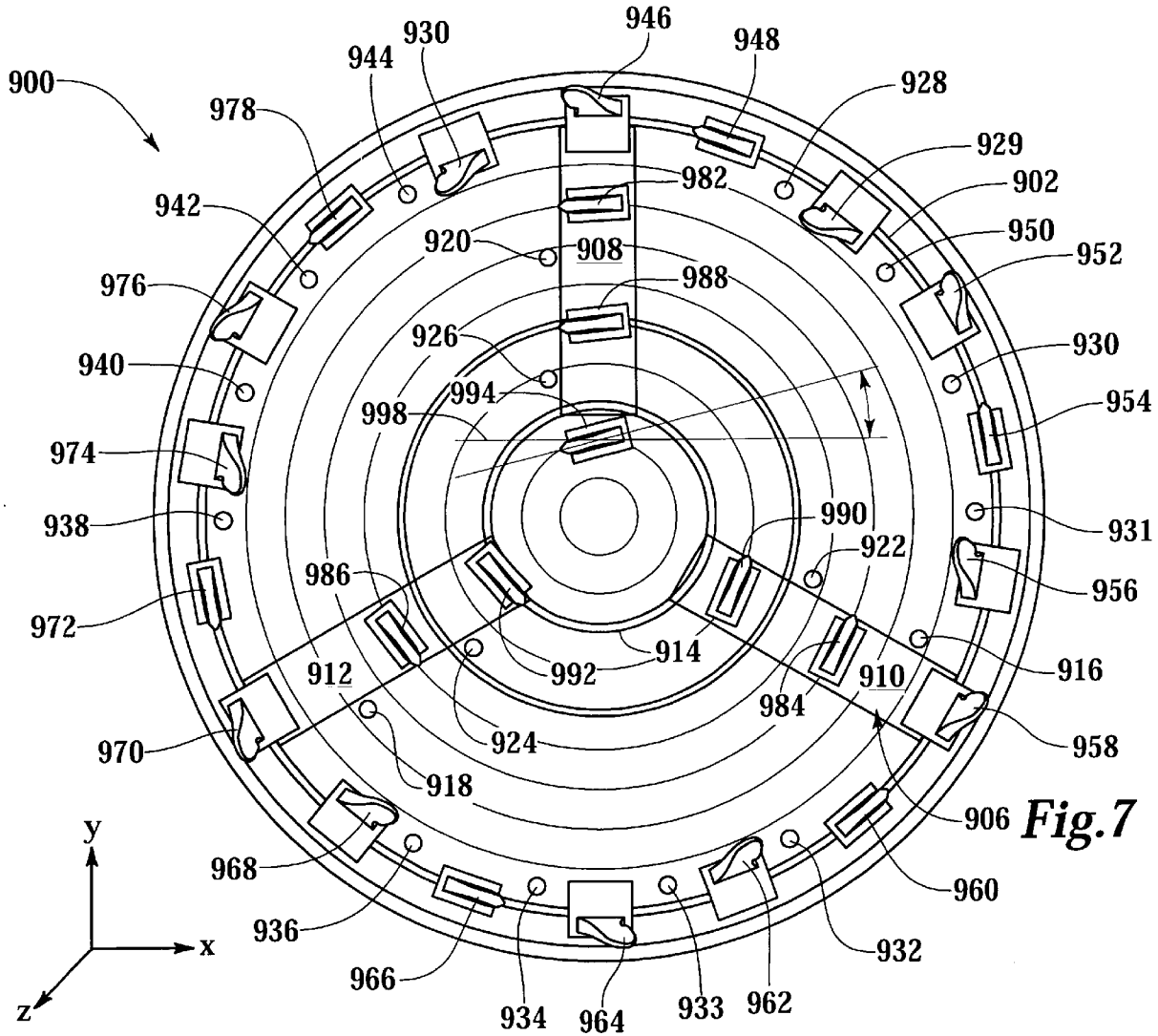
FIG. 7 is a front view of a fourth preferred embodiment of a water jet/mechanical cutting head for a horizontal remote mining system according to the present invention.

Referring now to FIG. 7, a preferred embodiment of a cutting head assembly 900 for a horizontal remote mining system is shown in greater detail. Although not shown in FIG. 7, cutting head 900 may be operatively coupled to auger body 400 as described hereinabove in connection with cutting head 200 in FIG. 2, or chassis 300 as described hereinabove in connection with cutting head 200 in FIG. 3.

Cutting head 900 generally includes an outer body 902; a "Y"-shaped frame 906 having three arms 908, 910, and 912 with a spacing of about 120 degrees; and a manifold 914. Although not shown in FIG. 7 for purposes of clarity of illustration, cutting head 900 also includes a plurality of hollow tubes extending from manifold 914 and for conveying water therein. These hollow tubes terminate in water jet nozzles 916, 918, 920, 922, 924, and 926, which are preferably disposed proximate selected ones of arms 908–912, and in water jet nozzles 928, 929, 930, 931, 932, 933, 934, 936, 938, 940, 942, and 944, which are preferably disposed proximate outer body 202. Nozzles 916–926 are preferably disposed on arms 908–912 at various radial distances from an axis of rotation 996 of cutting head 900. More preferably, nozzles 916–926 are disposed proximate arms 908–912 in a generally "spiral-shaped" pattern about axis of rotation 996. Nozzles 928–931 are preferably evenly spaced proximate outer body 902 between arms 908 and 910; nozzles 932–936 are preferably evenly spaced proximate outer body 902 between arms 910 and 912; and nozzles 938–944 are preferably evenly spaced proximate outer body 902 between arms 912 and 908. A plurality of mechanical bits, or cutters, 946–980 are disposed on outer body 902. Preferably, mechanical bits 946–980 are evenly spaced around the circumference of outer body 902. As is explained in more detail hereinbelow, a plurality of mechanical bits, or cutters, 982–994 are preferably disposed on arms 908–912 at various radial distances from axis of rotation 996. More preferably, mechanical bits 982–994 are disposed on arms 908–912 in a generally "spiral-shaped" pattern about axis of rotation 996. Mechanical bits 982, 988, 994 are associated with arm 908, and may be removably coupled to arm 908 via a bit block similar to bit block 714, described hereinabove in connection with cutting head 700 of FIG. 4, or may be coupled directly to arm 908 itself. Mechanical bits 984 and 990 are associated with arm 910, and may be removably coupled to warn 910 via a bit block similar to bit block 714, or may be coupled directly to arm 910 itself. Mechanical bits 986 and 992 are associated with arm 912, and may be removably coupled to arm 912 via a bit block similar to bit block 714, or may be coupled directly to arm 912 itself.

Cutting head 900 may be coupled to, rotated by, and moved in and out of borehole 122 by auger body 400 in substantially the same manner as cutting head 200. Alternatively, cutting head 700 may be coupled to, rotated by, and moved in and out of borehole 122 by chassis 300 in substantially the same manner as cutting head 200.

Mechanical bits 946–980 and 982–984 are preferably identical in structure to mechanical bits 210–234 of cutting head 200. Selected ones of mechanical bits 946–980 are preferably oriented straight ahead, or parallel to, axis of rotation 996, and other ones of these mechanical bits are preferably angled inward or outward from such axis. As shown in FIG. 7, mechanical bits 946–980 preferably alternate in a straight ahead, angled inward, angled outward repeating pattern. More preferably, mechanical bits 950, 956, 962, 968, 974, and 980 are angled inward relative to axis of rotation 996 at an angle of about 30 degrees, and mechanical bits 946, 952, 958, 964, 970, and 976 are angled outward relative to axis of rotation 996 at an angle of about 20 degrees. Mechanical bits 982–994 are preferably oriented straight ahead relative to axis of rotation 996 in the z-axis direction, but each of bits 982–994 is preferably oriented slightly inward, in the x-y plane of frame 906, toward axis of rotation 996 in different angles of less than about fifteen degrees. This angle of orientation in the x-y plane of frame 906 is most conveniently measured as the difference between a theoretical tangent line 998 proximate each of bits 982–994 and a line 1000 passing through the center of each of bits 982–994. It is believed that this angle of inward orientation in the x-y plane allows mechanical bits 982–994 to efficiently pulverize coal or other minerals cut by mechanical bits 946–980, nozzles 916–926, and nozzles 928–944 and more: effectively allow movement of material away from the cutting face. Of course, cutting head 900 may be formed with different numbers and angular orientations of mechanical bits for specific applications.

Nozzles 916–926 and 928–944 are preferably identical in structure to nozzles 236–250 of cutting head 200. Nozzles 916, 918, and 920 are preferably angled outward relative to axis of rotation 996 at different angles of less than about 5–10 degrees. Nozzles 922, 924, and 926 are preferably angled inward relative to axis of rotation 996 at different angles of less than 5–10 degrees. Nozzles 928, 930, 931, 932, 938, and 942 are preferably oriented straight ahead relative to axis of rotation 996. Nozzles 929, 933, 934 936, 940, and 944 are preferably angled outward relative to axis of rotation 996 at different angles of less than about 5–10 degrees. Therefore, upon rotation of cutting head 900, water ejected from nozzles 916–944 cut a larger diameter hole than mechanical bits 946–980 located on outer body 902. In addition, upon rotation of cutting head 900, water ejected from nozzles 916–944 cuts across substantially the entire face of cutting head 900, from axis of rotation 996 to beyond outer body 902. Of course, cutting head 900 may be formed with different numbers and angular orientations of water jet nozzles for specific applications.

By way of example, in a cutting head 900 having an outer body 902 with a diameter of about 50.25 inches, mechanical bits 948, 954, 960, 966, 972, and 978, which point straight ahead relative to axis of rotation 996, have tips located about 25.25 inches from axis of rotation 996. Mechanical bits 950, 956, 962, 968, 974, and 980, which are angled inward, have tips located about 22.5 inches from axis of rotation 996. Mechanical bits 946, 952, 958, 964, 970, and 976, which are angled outward, have tips located about 27.5 inches from axis of rotation 996. Mechanical bit 982 may be located about 20.0 inches from axis of rotation 996 and may have an angle of inward orientation in the x-y plane of about 3 degrees; mechanical bit 984 may be located about 17.5 inches from axis of rotation 996 and may have an angle of inward orientation in the x-y plane of about 4 degrees; mechanical bit 986 may be located about 15.0 inches from axis of rotation 996 and may have an angle of inward orientation in the x-y plane of about 5 degrees; mechanical bit 988 may be located about 12.5 inches from axis of rotation 996 and may have an angle of inward orientation in the x-y plane of about 5 degrees; mechanical bit 990 may be located about ten inches from axis of rotation 996 and have an angle of inward orientation in the x-y plane of about 7 degrees; mechanical bit 992 may be located about 7.5 inches from axis of rotation 990 and have an angle of inward orientation in the x-y plane of about 10 degrees; and mechanical bit 994 may be located about 5.0 inches from axis of rotation 996 and may have an angle of inward orientation in the x-y plane of about 12 degree. Nozzle 916 may be located about 23 inches from axis of rotation 996 and be angled outward relative to axis of rotation 996 at an angle of about 5 degrees; nozzle 918 may be located about 20 inches from axis of rotation 996 and be angled outward relative to axis of rotation 996 at an angle of about 5 degrees; nozzle 920 may be located about 21 inches from axis of rotation 996 and be angled outward relative to axis of rotation 996 at an angle of about 10 degrees; nozzle 922 may be located about 14 inches from axis of rotation 996 and be oriented straight ahead relative to axis of rotation 996; nozzle 924 may be located about 13 inches from axis of rotation 996 and be oriented straight ahead relative to axis of rotation 996; nozzle 926 may be located about 11 inches from axis of rotation 996 and be oriented straight ahead relative to axis of rotation 996. Nozzles 928, 930, 931, 932, 938, and 942 may be located about 25.1 inches from axis of rotation 996 and may be oriented straight ahead relative to axis of rotation 996. Nozzles 929, 933, 934, 936, 940, 944 may be located about 25.1 inches from axis of rotation 996 and may be angled outward relative to axis of rotation 996 at an angle of about 5–30 degrees. It is believed that these preferred dimensions may be extrapolated for a cutting head 900 having an outer body 202 with smaller or larger diameters.

Cutting head 900 may be used to mine a relatively thin, generally horizontal coal seam in a substantially similar User to that described above in connection with cutting head 200. When cutting head 900 is rotated and supplied with high pressure water to manifold 914, nozzles 916–926 and 928–944 create a generally circular, overlapping pattern of high pressure water on the surface of excavation region 114. Cutting head 900 is then advanced toward excavation region 114, via drill unit 500 or crawler 320, until mechanical bits 946–980 and 982–994 began to cut coal. Significantly, water ejected from nozzles 916–944 preferably cuts independently of mechanical bits 946–994.

Cutting head 900 provides the same, significant advantages over conventional mechanical, hydraulic, and mechanical/hydraulic cutting heads as described above in connection with cutting head 200. More specifically with respect to coal cutting rates, in hard coals, cutting head 900 using high pressure water at about 6000 psi and 150 gallons per minute developing a borehole diameter of approximately sixty inches achieves a penetration rate of approximately 6 feet/minute, as compared to approximately 3 feet/minute for a conventional scroll auger. In soft coals, similar improvements are expected. Cutting head 900 is particularly efficient in pulverizing coal or other minerals cut from borehole 122 to a smaller size, facilitating transport of such minerals out of borehole 122 into access tunnel 104. It is believed that such improved cutting rates are at least partially attributable to the fact that water ejected from nozzles 916–944 preferably cuts independently of mechanical bits 946–994.

Figure 8:
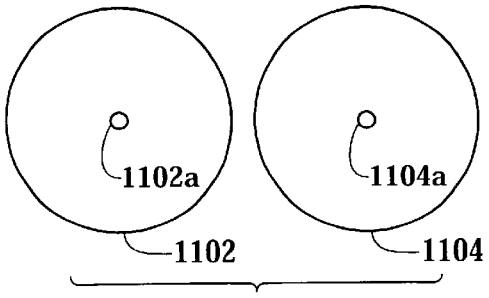
FIG. 8 is a front, schematic view of a first preferred embodiment of a cutting head system for a horizontal remote mining system according to the present invention.
Figure 9:
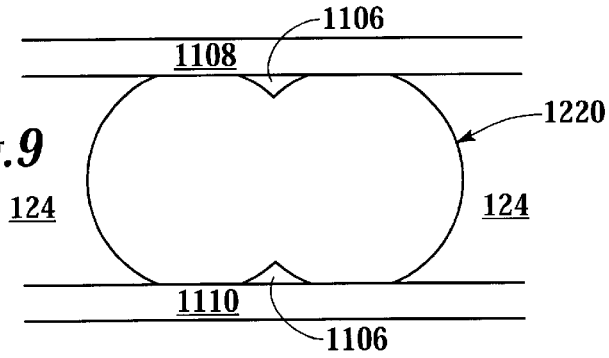
FIG. 9 is a front, sectional view of a borehole in a mineral seam formed with the cutting head system of FIG. 8.

Referring now to FIGS. 8 and 9, a preferred embodiment for a cutting head system 1100 for a horizontal remote mining system is shown. As shown in FIG. 8, cutting head system 1100 generally includes two cutting heads 1102 and 1104 arranged in a generally linear fashion and oriented with their axes of rotation 1102*a* and 1104*a* generally parallel to borehole 122. Any combination of cutting head 200, cutting head 700, cutting head 800, and cutting head 900 may be used as cutting heads 1102 and 1104. By way of example, cutting head 200 may be used for both cutting head 1102 and 1104. As another example, cutting head 200 could be used for cutting head 1102, and cutting head 900 could be used for cutting head 1104. Cutting heads 1102 and 1104 may each be operatively coupled to auger body 400 as described hereinabove in connection with cutting head 200 in FIG. 2, or cutting heads 1102 and 1104 may be operatively coupled to chassis 300 as described hereinabove in connection cutting head 200 in FIG. 3. Dual auger drill units 500 or a single auger drill unit 500 with an appropriate gearing system may be used to rotate cutting heads 1102 and 1104, and move cutting head system 1100 in and out of borehole 122, in substantially the same manner as described hereinabove for cutting head 200. Alternatively, a chassis similar to chassis 300 but with dual planetarys 304, gear assemblies 306, and electric motors 310 may be used to rotate cutting heads 1102 and 1104, and move cutting head system 1100 in and out of borehole 122, in substantially the same manner as described hereinabove for cutting head 200. More detail regarding a cut head system similar to cutting head system 1100 is found in the above-referenced U.S. Provisional Application No. 60/092,881.

Cutting head system 1100 may be used to mine a relatively thin, generally horizontal coal seam in a substantially similar manner to that described above in connection with cutting head 200. When cutting heads 1102 and 1104 are rotated and supplied with high pressure water, the water jet nozzles of heads 1102 and 1104 each create a generally circular, overlapping pattern of high pressure water on the surface of excavation region 114. Cutting head system 1100 is then advanced toward excavation region 114, via auger drill unit 500 or crawler 320, until its mechanical bits, if any, began to cut coal. As shown in FIG. 9, cutting head system 1100 creates a borehole 122*a* with a generally oval-shaped cross-section. Any kerfs or uncut sections 1106 proximate roof 1108 or floor 1110 of the coal seam may be removed, if necessary, by a separate, conventional mechanical and/or hydraulic cutting tool. Although only two cutting heads 1102 and 1104 are shown in FIG. 8, tee or more cutting heads can be arranged in a linear fashion so as to cut a generally oval borehole 122*a* with a greater width.

Figure 10:
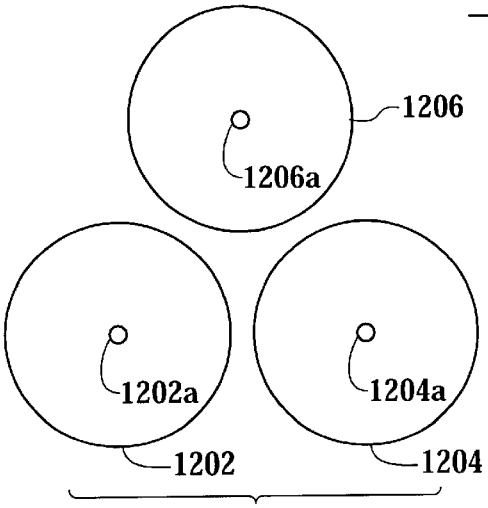
FIG. 10 is a front, schematic view of a second preferred embodiment of a cutting head system for a horizontal remote mining system according to the present invention.
Figure 11:
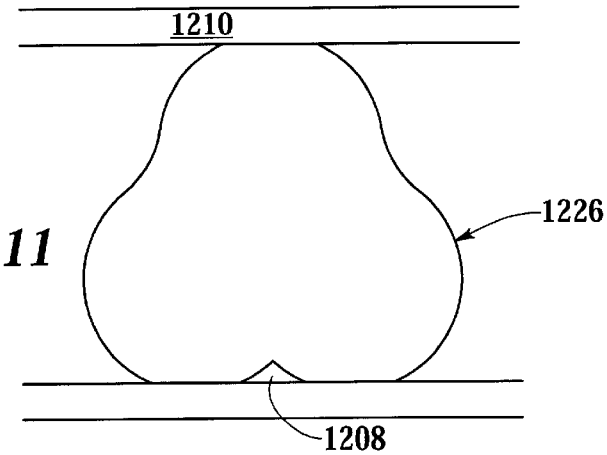
FIG. 11 is a front, sectional view of a borehole in a mineral seam formed with the cutting head system of FIG. 10.

Referring now to FIGS. 10 and 11, a preferred embodiment for a cutting head system 1200 for a horizontal rate mining system is shown. As shown in FIG. 10, cutting head system 1200 generally includes three cutting heads 1202, 1204, and 1206 arranged in a generally triangular arrangement and oriented with their axes of rotation 1202*a*, 1204*a*, and 1206*a* generally parallel to borehole 122. Any combination of cutting head 200, cutting head 700, cutting bead 800, and cutting head 900 may be used as cutting heads 1202, 1204, and 1206. For example, cutting head 700 may be used for each of cutting heads 1202, 1204, and 1206. As another example, cutting head 800 may be used for cutting heads 1202 and 1204, and cutting head 900 may be used for cutting head 1206. Cutting heads 1202, 1204, and 1206 may each be operatively coupled to auger body 400 as described hereinabove in connection with cutting head 200 in FIG. 2, or cutting heads 1202, 1204, and 1206 may be operatively coupled to chassis 300 as described hereinabove in connection with cutting head 200 in FIG. 3. An auger drill unit 500 with an appropriate gearing system may be used to rotate cutting beads 1202, 1204, and 1206, and move cutting head system 1200 in and out of borehole 122, in substantially the same manner as described hereinabove for cutting head 200. Alternatively, a chassis similar to chassis 300 but with three planetarys 304, gear assemblies 306, and electric motors 310 may be used to rotate cutting heads 1202, 1204, and 1206, and move cutting head system 1200 in and out of borehole 122, in substantially the same manner as described hereinabove for cutting head 200.

Cutting head system 1200 may be used to mine a relatively thin, generally horizontal coal seam in a substantially similar manner to that described above in connection with cutting head 200. When cutting heads 1202, 1204, and 1206 are rotated and supplied with high pressure water, the water jet nozzles of heads 1202, 1204, and 1206 each create a generally circular, overlapping pattern of high pressure water on the surface of excavation region 114. Cutting head system 1200 is then advanced toward excavation region 114, via auger drill unit 500 or crawler 320, until its mechanical bits, if any, began to cut coal. As shown in FIG. 11, cutting head system 1200 creates a borehole 122*b* with a generally "pie-shaped" cross-section. Any kerf or uncut section 1208 proximate a roof 1210 of the coal seam may be removed, if necessary, by a separate, conventional mechanical and/or hydraulic cutting tool. Of course, cutting head system 1200 may be arranged so that the cross-section of generally pie-shaped borehole 122*b* is inverted from the cross-section shown in FIG. 11. More detail regarding the formation of generally pie-shaped boreholes 122*b* is found in the above-referenced U.S. application Ser. No. 08/745,459.

From the above, one skilled in the art will appreciate that the cutting heads and cutting head systems of the present invention provide reliable and economic means of mining relatively thin, generally horizontal coal (or other mineral) seams. The cutting heads and cutting bead systems of the present invention also provide improved cutting rates and navigation within such relatively thin, generally horizontal minerals. Furthermore, the cutting head systems of the present invention provide improved protection against subsidence and roof failure of the mineral seam.

The present invention is illustrated herein by example, and various modifications may be made by a person of ordinary skill in the art. For example, numerous relative dimensions of the various cutting heads may be altered to accommodate specific applications of the invention.

It is thus believed that the operation and construction of the present invention will be apparent from the foregoing description. While the method and apparatus shown or described have been characterized as being preferred it will be obvious that various changes and modifications may be made therein without departing from the spirit and scope of the invention as defined in the following claims.

What is claimed is:

1. A cutting head for creating a borehole in a mineral seam, comprising:

a first body having a manifold for containing high pressure fluid and an axis of rotation generally parallel to said borehole;

a first plurality of mechanical bits disposed on said first body;

a first plurality of nozzles disposed around said axis of rotation for spraying said high pressure fluid; and a plurality of tubes fluidly coupling said manifold and said first plurality of nozzles;

whereby on supplying high pressure fluid to said manifold and rotating said cutting head about said axis of rotation, said nozzles create a generally circular, overlapping pattern of high pressure fluid in front of said cutting head, said pattern of high pressure fluid being directed to cut said borehole independently of said first plurality of mechanical bits.

2. The cutting head of claim 1 wherein said fluid is water.

3. The cutting head of claim 1 wherein selected ones of said first plurality of nozzles are spaced at different radii from said axis of rotation.

4. The cutting head of claim 1 wherein selected ones of said first plurality of mechanical bits are spaced at different radii from said axis of rotation.

5. The cutting head of claim 1 wherein said first body comprises first, second, and third arms arranged in a generally coplanar relationship, spaced about 120 degrees apart, and centered on said axis of rotation.

6. The cutting head of claim 5 wherein each of said first, second, and third arms comprises a bit block removably coupled to said arm.

7. The cutting head of claim 6 wherein said first plurality of mechanical bits are coupled to said bit blocks.

8. The cutting head of claim 5 wherein said first plurality of mechanical bits are disposed on said first, second, and third arms in a plurality of circular groupings around said axis of rotation, each of said circular groupings having a different radius from said axis of rotation.

9. The cutting head of claim 8 comprising:

a first circular grouping of mechanical bits having a first radius from said axis of rotation; and a second circular grouping of mechanical bits having a second radius from said axis of rotation greater than said first radius.

10. The cutting head of claim 9 wherein:

at least a first one of said first plurality of nozzles is disposed proximate said first circular grouping of mechanical bits;

at least a second one of said first plurality of nozzles is disposed between said first circular grouping of mechanical bits and said second circular grouping of mechanical bits; and at least a third one of said first plurality of nozzles is disposed proximate said second circular grouping of mechanical bits.

11. The cutting head of claim 10 wherein said at least first one of said first plurality of nozzles is angled inward relative to said axis of rotation.

12. The cutting head of claim 11 wherein said at least first one of said first plurality of nozzles is angled inward relative to said axis of rotation at an angle of less than about thirty degrees.

13. The cutting head of claim 10 wherein said at least second one and said at least third one of said first plurality of nozzles are angled outward relative to said axis of rotation.

14. The cutting head of claim 13 wherein said at least second one and said at least third one of said first plurality of nozzles are angled outward relative to said axis of rotation at an angle of less than about thirty degrees.

15. The cutting head of claim 9 and further comprising:

a third circular grouping of mechanical bits having a third radius from said axis of rotation greater than said first radius and less Wan said second radius; and a fourth circular grouping of mechanical bits having a fourth radius from said axis of rotation greater than said third radius and less than said second radius.

16. The cutting head of claim 1 wherein said pattern of high pressure fluid is directed to cut at a diameter larger than a cutting diameter of said first plurality of mechanical bits.

17. The cutting head of claim 1 wherein said pattern of high pressure fluid is directed to cut across substantially an entire face of said cutting head.

18. The cutting head of claim 1 further comprising a second body having a generally cylindrical cross-section and said axis of rotation, and wherein said first body is disposed within said second body.

19. The cutting head of claim 18 wherein said first plurality of nozzles are disposed around said axis of rotation between said first body and said second body.

20. The cutting head of claim 18 further comprising a second plurality of mechanical bits disposed around a periphery of said second body, and wherein said first plurality of nozzles are disposed around said axis of rotation between said first body and said second body.

21. The cutting head of claim 20 wherein:

at least one of said second plurality of mechanical bits is angled inward relative to said axis of rotation; and at least one of said second plurality of mechanical bits is angled outward relative to said axis of rotation.

22. The cutting head of claim 21 wherein said second plurality of mechanical bits are angled, relative to said axis of rotation, in a straight ahead, angled inward, angled outward repeating pattern around said periphery of said second body.

23. The cutting head of claim 20 wherein:

at least a first one of said first plurality of nozzles is disposed proximate said first body;

at least a second one of said first plurality of nozzles is disposed between said first body and said second body; and at least a third one of said first plurality of nozzles is disposed proximate said second body.

24. The cutting head of claim 23 wherein said at least first one of said first plurality of nozzles is angled inward relative to said axis of rotation.

25. The cutting head of claim 24 wherein said at least first one of said first plurality of nozzles is angled inward relative to said axis of rotation at an angle between about zero and about thirty degrees.

26. The cutting head of claim 23 wherein said at least second one and said at least third one of said first plurality of nozzles are angled outward relative to said axis of rotation.

27. The cutting head of claim 26 wherein said at least second one and said at least third one of said first plurality of nozzles are angled outward relative to said axis of rotation at an angle between about zero and about thirty degrees.

28. The cutting head of claim 18 wherein said first body has a generally cylindrical cross-section, and said first plurality of mechanical bits are disposed around a periphery of said first body.

29. The cutting head of claim 28 wherein:

at least one of said first plurality of mechanical bits is angled inward relative to said axis of rotation; and at least one of said first plurality of mechanical bits is angled outward relative to said axis of rotation.

30. The cutting head of claim 29 wherein said first plurality of mechanical bits are angled, relative to said axis of rotation, in an angled inward, angled outward repeating pattern around said periphery of said first body.

31. The cutting head of claim 18 further comprising:

a second plurality of mechanical bits disposed on said second body; and wherein said pattern of high pressure fluid is directed to cut at a diameter larger than a cutting diameter of said second plurality of mechanical bits.

32. The cutting head of claim 18 wherein said pattern of high pressure fluid is directed to cut across substantially an entire face of said cutting head.

33. The cutting head of claim 18 wherein said first plurality of nozzles are spaced at different radii from said axis of rotation.

34. The cutting head of claim 33 wherein at least a first one of said first plurality of nozzles is angled inward relative to said axis of rotation.

35. The cutting head of claim 34 wherein said at least first one of said first plurality of nozzles is angled inward relative to said axis of rotation in an angle of less than about 10 degrees.

36. The cutting head of claim 34 wherein at least a second one of said first plurality of nozzles is angled outward relative to said axis of rotation.

37. The cutting head of claim 36 wherein said at least second one of said first plurality of nozzles is angled outward relative to said axis of rotation at an angle of less than about 30 degrees.

38. The cutting head of claim 18 wherein said first plurality of mechanical bits are spaced a different radii from said axis of rotation.

39. The cutting head of claim 18 wherein said first body comprises first, second, and third arms arranged in a generally coplanar relationship, spaced about 120 degrees apart, and centered on said axis of rotation.

40. The cutting head of claim 39 wherein each of said first, second, and third arms comprises a bit block removably coupled to said arm.

41. The cutting head of claim 40 wherein said first plurality of mechanical bits are coupled to said bit blocks.

42. The cutting head of claim 39 wherein said first plurality of mechanical bits are disposed on said first, second, and third arms in a plurality of circular groupings around said axis of rotation, each of said circular groupings having a different radius from said axis of rotation.

43. The cutting head of claim 39 wherein said first plurality of mechanical bits are disposed on said first, second, and third arms in a generally spiral-shaped arrangement about said axis of rotation.

44. The cutting head of claim 18 wherein said first plurality of nozzles are disposed in a generally coplanar, spiral-shaped arrangement about said axis of rotation.

45. The cutting head of claim 18 further comprising a second plurality of mechanical bits disposed around a periphery of said second body.

46. The cutting head of claim 45 wherein:

at least one of said second plurality of mechanical bits is angled inward relative to said axis of rotation; and at least one of said second plurality of mechanical bits is angled outward relative to said axis of rotation.

47. The cutting head of claim 46 wherein said second plurality of mechanical bits are angled, relative to said axis of rotation, in a straight ahead, angled inward, angled outward repeating pattern around said periphery of said second body.

48. The cutting head of claim 45 further comprising a second plurality of nozzles disposed proximate a periphery of said second body.

49. The cutting head of claim 48 wherein at least a first one of said second plurality of nozzles is angled inward relative to said axis of rotation.

50. The cutting head of claim 49 wherein said at least first one of said second plurality of nozzles is angled inward relative to said axis of rotation in an angle of less than about 10 degrees.

51. The cutting head of claim 49 wherein at least a second one of said second plurality of nozzles is angled outward relative to said axis of rotation.

52. The cutting head of claim 51 wherein said at least second one of said second plurality of nozzles is angled outward relative to said axis of rotation at an angle of less than about 30 degrees.

53. A cutting head for creating a borehole in a mineral seam, comprising:

a first body having a manifold for containing high pressure fluid and an axis of rotation generally parallel to said borehole;

a plurality of nozzles disposed around said axis of rotation for spraying said high pressure fluid; and a plurality of tubes fluidly coupling said manifold and said first plurality of nozzles;

whereby on supplying high pressure fluid to said manifold and rotating said cutting head about said axis of rotation, said nozzles create a generally circular, overlapping pattern of high pressure fluid in front of said cutting head, said pattern of high pressure fluid being directed to cut across substantially an entire face of said cutting head.

54. The cutting head of claim 53 wherein said fluid is water.

55. The cutting head of claim 53 wherein selected ones of said plurality of nozzles are spaced at different radii from said axis of rotation.

56. The cutting head of claim 53 wherein said plurality of nozzles comprises:

a first circular grouping of nozzles disposed at similar radial distances from said axis of rotation and proximate said first body;

a second circular grouping of nozzles disposed at similar radial distances from said axis of rotation but outside said first circular grouping of nozzles.

57. The cutting head of claim 56 wherein:

at least a first one of said first circular grouping of nozzles is angled inward relative to said axis of rotation; and at least a first one of said second circular grouping of nozzles is angled outward relative to said axis of rotation.

58. The cutting head of claim 56 wherein:

said at least first one of said first circular grouping of nozzles is angled inward relative to said axis of rotation at an angle between about zero and about twenty degrees; and at least a first one of said second circular grouping of nozzles is angled outward relative to said axis of rotation at an angle of less than about twenty-five degrees.

59. The cutting head of claim 58 and further comprising a third circular grouping of nozzles disposed at similar radial distances from said axis of rotation and between said first circular grouping of nozzles and said second circular grouping of nozzles.

60. The cutting head of claim 59 wherein at least a first one of said third circular grouping of nozzles is angled outward relative to said axis of rotation.

61. The cutting head of claim 60 wherein said at least a first one of said third circular grouping of nozzles is angled outward relative to said axis of rotation at an angle of less than about twenty degrees.

62. The cutting head of claim 57 further comprising a second body having a generally cylindrical cross-section and said axis of rotation, and wherein:

said first body is disposed within said second body, and said first body has first, second, third, and fourth arms arranged in a generally coplanar relationship and spaced about ninety degrees apart;

said first circular grouping of nozzles comprises a nozzle proximate each of said first, second, third, and fourth arms, and said first circular grouping of nozzles is disposed proximate said axis of rotation; and said second circular grouping of nozzles comprises a nozzle proximate each of said first, second, third, and fourth arms, and said second circular grouping of nozzles is disposed proximate said second body.

63. The cutting head of claim 53 further comprising a second body having a generally cylindrical cross-section and said axis of rotation, and wherein said first body is disposed within said second body.

64. A method of creating a borehole in a mineral seam, comprising the steps of:

providing a cutting head having:

a manifold for containing high pressure fluid;

an axis of rotation generally parallel to said borehole;

a plurality of mechanical bits disposed at various radii around said axis of rotation;

and a plurality of nozzles disposed at various radii around said axis of rotation for spraying said high pressure fluid;

positioning said cutting head proximate a mineral seam;

supplying said high pressure fluid to said manifold;

rotating said cutting head about said axis of rotation to create a generally circular, overlapping pattern of high pressure fluid in front of said cutting head; and cutting said borehole with said rotating pattern of high pressure fluid and said mechanical bits, said high pressure fluid provided at a pressure sufficient to cut said mineral seam, but insufficient to cut rock that borders said seam, said high pressure fluid cutting said borehole independently of said mechanical bits.

65. The method of claim 64 wherein said supplying step comprises supplying high pressure water to said manifold.

66. The method of claim 64 wherein said rotating step creates said pattern of high pressure fluid with a diameter larger than a cutting diameter of said plurality of mechanical bits to cut mineral material outside of said cutting diameter of said plurality of mechanical bits.

67. The method of claim 64 wherein said rotating step creates said pattern of high, pressure fluid across substantially an entire face of said cutting head.

68. The method of claim 64 wherein said rotating step comprises: providing a chassis having:

means for rotating said cutting head; and means for supplying high pressure fluid to said manifold; coupling said chassis to said cutting head;

utilizing said rotating means to rotate said cutting head.

69. The method of claim 68 wherein said means for rotating said cutting head and said means for supplying high pressure water to said manifold comprise of a planetary or other gear reduction having a hollow shaft for delivery of said high pressure fluid.

70. The method of claim 68 wherein said chassis comprises a conveyor, powered by an electric motor for moving cut material away from said cutting head.

71. The method of claim 64 wherein said rotating step comprises:

providing an auger body;

coupling said auger body to said cutting head;

coupling said auger body to a drill unit disposed remote from said cutting head; and rotating said cutting head and said auger body with said drill unit.

72. The method of claim 71 wherein said supplying step comprises supplying high pressure fluid to said manifold via a hollow shaft of said auger body.

73. The method of claim 71 wherein said rotating step moves cut material away from said cutting head using said auger body.

74. The method of claim 64 further comprising the step of removing cut material away from said cutting head.

75. The method of claim 64 wherein said mineral seam is a relatively thin, generally horizontal mineral seam.

76. The method of claim 64 wherein said mineral seam is a coal seam.

77. The method of claim 64 wherein said mineral seam is an underground mineral seam.

78. A method of creating a borehole in a mineral seam, comprising the steps of:

providing a cutting head having:

a manifold for containing high pressure fluid;

an axis of rotation generally parallel to said borehole; and a plurality of nozzles disposed at various radii around said axis of rotation for spraying said high pressure fluid;

positioning said cutting head proximate a mineral seam;

supplying said high pressure fluid to said manifold;

rotating said cutting head about said axis of rotation to create a generally circular, overlapping pattern of high pressure fluid in front of said cutting head and across substantially an entire face of said cutting head; and cutting said borehole with said rotating pattern of high pressure fluid, said high pressure fluid provided at a pressure sufficient to cut said mineral seam, but insufficient to cut rock that borders said seam.

79. The method of claim 78 wherein said supplying step comprises supplying high pressure water to said manifold.

80. The method of claim 78 wherein said rotating step comprises:

providing a chassis having:

means for rotating said cutting head; and means for supplying high pressure fluid to said manifold;

coupling said chassis to said cutting head;

utilizing said rotating means to rotate said cutting head.

81. The method of claim 80 wherein said means for rotating said cutting head and said means for supplying high pressure water to said manifold comprise of a planetary or other gear reduction having a hollow shaft for delivery of said high pressure fluid.

82. The method of claim 80 wherein said chassis comprises a conveyor, powered by an electric motor for moving cut material away from said cutting head.

83. The method of claim 78 wherein said rotating step comprises:

providing an auger body;

coupling said auger body to said cutting head;

coupling said auger body to a drill unit disposed remote from said cutting head; and rotating said cutting head and said auger body with said drill unit.

84. The method of claim 83 wherein said supplying step comprises supplying high pressure fluid to said manifold via a hollow shaft of said auger body.

85. The method of claim 83 wherein said rotating step moves cut material away from said cutting head using said auger body.

86. The method of claim 78 further comprising the step of removing cut material away from said cutting head.

87. The method of claim 78 wherein said mineral seam is a relatively thin, generally horizontal mineral seam.

88. The method of claim 78 wherein said mineral seam is a coal seam.

89. The method of claim 78 wherein said mineral seam is an underground mineral seam.

90. A cutting head system for creating a borehole in a mineral seam, comprising:

a first cutting head, comprising:

a manifold for containing high pressure fluid;

an axis of rotation generally parallel to said borehole;

a first plurality of nozzles disposed at various radii around said axis of rotation for spraying said high pressure fluid for creating a first generally circular pattern of high pressure fluid in front of said first cutting head for cutting said borehole; and a plurality of hollow tubes fluidly coupling said manifold and said first plurality of nozzles; and a second cutting head substantially identical to said first cutting head having a second axis of rotation generally parallel to said borehole and having a second plurality of nozzles, said second cutting head arranged in a generally linear fashion with said first cutting head, said second plurality of nozzles for creating a second generally circular pattern of high pressure fluid in front of said second cutting head for cutting said borehole;

whereby on supplying high pressure fluid to said manifolds, rotating said first cutting head about said axis of rotation, and rotating said second cutting head about said second axis of rotation, said first generally circular pattern and said second generally circular pattern overlapping to create a pattern of high pressure fluid in front of said cutting heads for cutting said borehole with a generally oval-shaped cross-section.

91. The cutting head system of claim 90, wherein said adjacent patterns of high pressure fluid are each directed to cut across substantially an entire face of said first and second cutting heads.

92. The cutting head system of claim 90, wherein:

said first cutting head comprises a plurality of mechanical bits disposed at various radii around said axis of rotation; and whereby said adjacent pattern of high pressure fluid of said first cutting head is directed to cut said borehole independently of said plurality of mechanical bits.

93. The cutting head system of claim 90 wherein said fluid is water.

94. A cutting head system for creating a borehole in a mineral seam, comprising:

a first cutting head, comprising:

a manifold for containing high pressure fluid;

an axis of rotation generally parallel to said borehole;

a first plurality of nozzles disposed at various radii around said axis of rotation for spraying said high pressure fluid for creating a first generally circular pattern of high pressure fluid in front of said first cutting head for cutting said borehole; and a plurality of hollow tubes fluidly coupling said manifold and said first plurality of nozzles; and a second cutting head substantially identical to said first cutting head having a second axis of rotation generally parallel to said borehole and having a second plurality of nozzles, said second plurality of nozzles for creating a second generally circular pattern of high pressure fluid in front of said second cutting head for cutting said borehole; and a third cutting head substantially identical to said first cutting head having a third axis of rotation generally parallel to said borehole, and having a third plurality of nozzles, said third plurality of nozzles for creating a third generally circular pattern of high pressure fluid in front of said third cutting head for cutting said borehole;

said first, second, and third cutting heads arranged in a generally triangular arrangement;

whereby on supplying high pressure fluid to said manifolds, rotating said first cutting head about said axis of rotation, rotating said second cutting head about said second axis of rotation, and rotating said third cutting head about said third axis of rotation, said nozzles on said first, second, and third cutting heads create said first, said second, and said third generally circular, overlapping patterns of high pressure fluid in front of said cutting heads and for cutting said borehole with a generally pie-shaped cross-section.

95. The cutting head system of claim 94, wherein said three patterns of high pressure fluid are each directed to cut across substantially an entire face of said first, second, and third cutting heads.

96. The cutting head system of claim 94, wherein:

said first cutting head comprises a plurality of mechanical bits disposed at various radii around said axis of rotation; and whereby said pattern of high pressure fluid of said first cutting head is directed to cut said borehole independently of said plurality of mechanical bits.

97. The cutting head system of claim 94 wherein said fluid is water.

* * * * *

UNITED STATES PATENT AND TRADEMARK OFFICE

CERTIFICATE OF CORRECTION

PATENT NO. : 6,364,418 B1
DATED : April 2, 2002
INVENTOR(S) : Jeff Schwoebel

It is certified that error appears in the above-identified patent and that said Letters Patent is hereby corrected as shown below:

Column 2,
Line 21, delete "tort slurry" replace with -- transport slurry --
Line 52, delete "cavity is creed" replace with -- cavity is created --

Column 4,
Line 23, delete "he present invention" replace with -- the present invention --
Line 55, delete "The cutting bead" replace with -- The cutting head --

Column 5,
Line 17, delete "oval-shape" replace with -- oval-shaped --

Column 6,
Line 33, delete "coal sewn" replace with -- coal seam --
Line 36, delete "subterranean non entries" replace with -- subterranean main entries --

Column 7,
Line 53, delete "Lafeyette, Ind.," replace with -- Lafeyette, IN., --
Line 55, delete "hydrauic pump" replace with -- hydraulic pump --

Column 8,
Line 4, delete "scroll auger" replace with -- scroll augerheads --
Lines 20-21, delete "Durango, Colo." replace with -- Durango, CO --

Column 10,
Line 9, delete "to the bead" replace with -- to the head --
Line 24, delete "length represent" replace with -- length represents --
Line 39, delete "that bowers" replace with -- that borders --

UNITED STATES PATENT AND TRADEMARK OFFICE

CERTIFICATE OF CORRECTION

PATENT NO. : 6,364,418 B1
DATED : April 2, 2002
INVENTOR(S) : Jeff Schwoebel

It is certified that error appears in the above-identified patent and that said Letters Patent is hereby corrected as shown below:

Column 11,
Line 59, delete "of cutting bead" replace with -- of cutting head --

Column 12,
Line 12, delete "about sit to about" replace with -- about sixty to about --
Line 48, delete "water herein" replace with -- water therein --

Column 15,
Line 19, delete "to warn 910" replace with -- to arm 910 --

Column 16,
Line 41, delete "12 degree." replace with -- 12 degrees. --

Column 17,
Line 1, delete "User to that" replace with -- manner to that --
Line 55, delete "a cut head system" replace with -- a cutting head system --

Column 18,
Line 7, delete "tee or more" replace with -- three or more --
Line 11, delete "horizontal rate" replace with -- horizontal remote --
Line 30, delete "cutting beads" replace with -- cutting heads --
Line 65, delete "cutting bead system" replace with -- cutting head systems --

Column 19,
Line 1, delete "minerals." replace with -- mineral seams. --

UNITED STATES PATENT AND TRADEMARK OFFICE

CERTIFICATE OF CORRECTION

PATENT NO. : 6,364,418 B1
DATED : April 2, 2002
INVENTOR(S) : Jeff Schwoebel

It is certified that error appears in the above-identified patent and that said Letters Patent is hereby corrected as shown below:

Column 20,
Line 25, delete "less Wan" replace with -- less than --

Column 23,
Line 7, delete "claim 56 wherein" replace with -- claim 57 wherein --

Signed and Sealed this

Fifteenth Day of October, 2002

*Attest:*

*Attesting Officer*

JAMES E. ROGAN
*Director of the United States Patent and Trademark Office*